US007165974B2

(12) United States Patent
Kooiman

(10) Patent No.: US 7,165,974 B2
(45) Date of Patent: Jan. 23, 2007

(54) MULTIPLE-POSITION PUSH-ON ELECTRICAL CONNECTOR

(75) Inventor: John A. Kooiman, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/967,046

(22) Filed: Oct. 14, 2004

(65) Prior Publication Data

US 2006/0084286 A1 Apr. 20, 2006

(51) Int. Cl.
*H01R 12/00* (2006.01)

(52) U.S. Cl. ..... 439/63; 439/578

(58) Field of Classification Search ..... 439/578–585, 439/63, 675, 874, 473, 468, 466
See application file for complete search history.

(56) References Cited

U.S. PATENT DOCUMENTS

| | | | | |
|---|---|---|---|---|
| 4,605,269 | A * | 8/1986 | Cohen et al. | 439/63 |
| 4,772,222 | A * | 9/1988 | Laudig et al. | 439/578 |
| 4,895,521 | A | 1/1990 | Grabbe | 439/63 |
| 4,900,258 | A | 2/1990 | Hnatuck et al. | 439/63 |
| 5,046,952 | A | 9/1991 | Cohen et al. | 439/63 |
| 5,122,063 | A * | 6/1992 | Cooper | 439/13 |
| 5,203,717 | A | 4/1993 | Beck et al. | 439/460 |
| 5,273,443 | A | 12/1993 | Frantz et al. | 439/595 |
| 5,295,863 | A | 3/1994 | Cady | 439/578 |
| 5,611,707 | A | 3/1997 | Meynier | 439/353 |
| 5,842,872 | A | 12/1998 | Hosler, Sr. et al. | 439/63 |
| 5,890,926 | A | 4/1999 | Pauza et al. | 439/445 |
| 5,906,511 | A | 5/1999 | Bozzer et al. | 439/579 |
| 6,071,127 | A | 6/2000 | Acke et al. | 439/63 |
| 6,309,251 | B1 * | 10/2001 | Tang | 439/584 |
| 6,338,653 | B1 | 1/2002 | Jones et al. | 439/579 |
| 6,344,736 | B1 * | 2/2002 | Kerrigan et al. | 324/158.1 |

(Continued)

FOREIGN PATENT DOCUMENTS

| | | |
|---|---|---|
| EP | 0 582 960 | 2/1994 |

(Continued)

OTHER PUBLICATIONS

Corning Gilbert, Inc., 2002 Microwave Products Catalog, Feb. 2002, p. 20.

*Primary Examiner*—Truc T. Nguyen
*Assistant Examiner*—Edwin A. Leon
(74) *Attorney, Agent, or Firm*—Marvin A. Glazer; Joseph M. Homa

(57) ABSTRACT

A multi-port, electrical connector (100) includes a housing (105) having cable ports (122–128) for coaxial cables (421–428) on a cable side (101) of the housing and male push-on ports (271–278) for female connectors (801) on a male side (202). Each cable port has nonstandard internal threads (160). Each coaxial cable is terminated with a cable adapter (120). A coaxial cable-cable adapter combination is removably secured to each cable port by a clamp nut (130) having nonstandard external threads (660). Each coaxial cable-cable adapter combination is individually field replaceable. Another multi-port electrical connector (1000) includes a housing (1005) having male, push-on ports (1021–1028) on a male side (1001) of the housing and printed wiring board (PWB) ports (1171–1178) on a PWB side (1102). Each PWB port includes a straight PWB pin (1181–1188) for insertion into a hole in a PWB (1301).

38 Claims, 15 Drawing Sheets

U.S. PATENT DOCUMENTS

| | | | | |
|---|---|---|---|---|
| 6,547,593 | B1 | 4/2003 | Beckous | 439/581 |
| 6,679,728 | B1 * | 1/2004 | Huang et al. | 439/579 |
| 6,692,262 | B1 | 2/2004 | Loveless | 439/63 |
| 2001/0004555 | A1 | 6/2001 | Harting et al. | 439/63 |
| 2002/0137370 | A1 | 9/2002 | Harting et al. | 439/83 |
| 2004/0038586 | A1 | 2/2004 | Hall et al. | 439/578 |
| 2004/0092165 | A1 | 5/2004 | Holland | 439/607 |
| 2004/0137790 | A1 | 7/2004 | Lee et al. | 439/582 |
| 2004/0203283 | A1 | 10/2004 | Chen et al. | 439/578 |

FOREIGN PATENT DOCUMENTS

| | | |
|---|---|---|
| WO | WO 98/33243 | 7/1998 |

* cited by examiner

MULTIPLE-POSITION PUSH-ON ELECTRICAL CONNECTOR

BACKGROUND OF THE INVENTION

1. Field of the Invention

This invention relates to electrical connectors, and more particularly to an electrical connector system having a plurality of push-on style interfaces and designed to connect a plurality of coaxial cables to a printed wiring board.

2. Description of the Related Art

Microwave connectors having a push-on style interface, such as a subminiature push-on ("SMP") interface and a SMP-miniature ("SMPM") interface, as described in MIL-STD-348A, are well known. Microwave connectors having a port with a push-on style interface designed to connect a coaxial cable to a printed wiring board ("PWB") are well known. However, all such known microwave connectors having a push-on style interface are single-position connectors. When a plurality of coaxial cables are coupled to a PWB, a plurality of single-position connectors is needed. Disadvantageously, the plurality of coaxial cables cannot be uncoupled from the plurality of single-position connectors with a single action. Furthermore, known single-position microwave connectors having a push-on style interface have a cable adapter that is press-fit into the connector body, thereby disadvantageously being thermally integral with the connector body, which can slow the process of soldering a coaxial cable to the cable adapter.

Some multiple-position coaxial cable connectors have a provision for the individual coaxial cable and connector assemblies to be field replaceable. Such known multiple-position coaxial cables connectors have a spring-action snap ring, a plastic insert, and a lip on the connector. Such known multiple-position coaxial cables connectors are disadvantageously relatively large—usually about two inches in diameter.

Multiple-position connectors designed to connect a coaxial cable to a PWB are also well known. However, all known multiple-position connectors designed to connect a coaxial cable to a PWB lack any provision to allow the coaxial cables to be individually field replaceable.

OBJECTS OF THE INVENTION

It is therefore an object of the present invention to provide a multi-position, connector with male, push-on ports having smaller dimensions than prior art multi-position connectors have.

It is another object of the present invention to provide a multi-position, coaxial cable-to-male, push-on connector assembly in which each individual coaxial cable attached to the connector is field replaceable.

It is yet another object of the present invention to provide a coaxial cable-to-PWB connector system that allows a user to make and break a plurality of coaxial cable-to-PWB connections with a single action.

These and other objects of the present invention will become apparent to persons skilled in the art as the description thereof proceeds.

BRIEF DESCRIPTION OF THE DRAWINGS

The present invention will be described with greater specificity and clarity with reference to the following drawings, in which.

Figure 1:
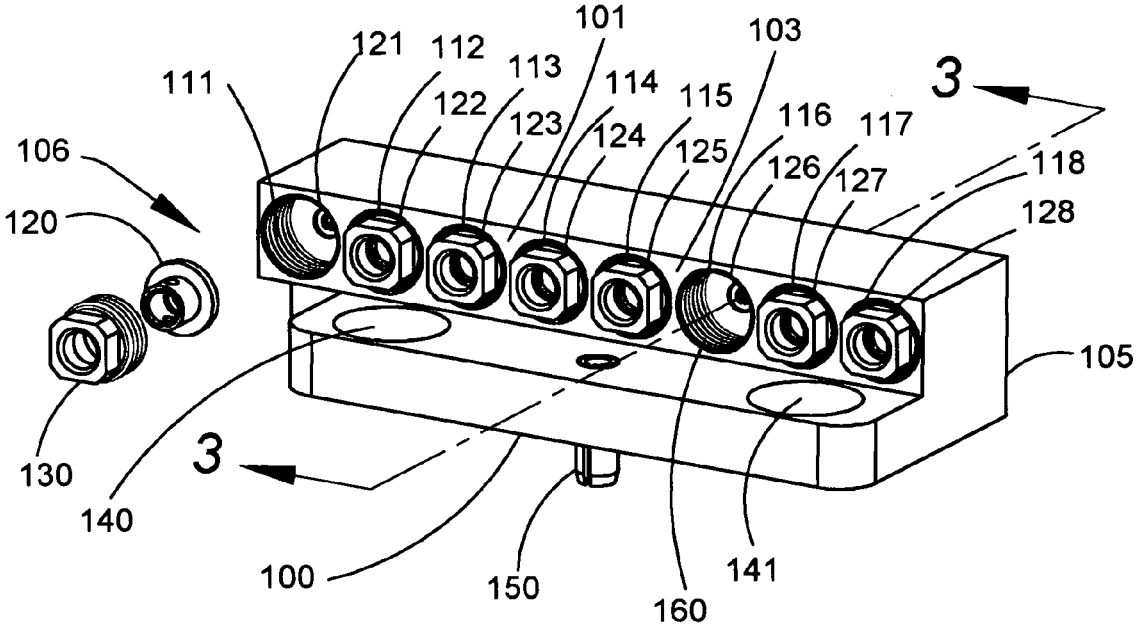
FIG. 1 is a perspective view of an eight-position, right-angle, coaxial cable-to-male, push-on connector including a cable adapter and a clamp nut at several of the cable ports, and including an exploded view at one of the cable ports.

For simplicity and clarity of illustration, the drawing figures illustrate the general manner of construction, and descriptions and details of well-known features and techniques are omitted to avoid unnecessarily obscuring the invention. Furthermore, elements in the drawing figures are not necessarily drawn to scale.

DETAILED DESCRIPTION OF THE PREFERRED EMBODIMENT

FIG. 1 is a perspective view of an eight-position, right-angle, coaxial cable-to-male, push-on, electrical connector 100. Hereinafter, "electrical connector" may also be referred to as "connector". The connector 100 comprises a housing 105, preferably a metallic housing. The housing 105 has a first face 103 and a second face 204 (see FIG. 2). The plane of the second face 204 is at a right angle to the plane of the first face 103. Each position of the connector 100 comprises one cable port and one male port. The connector 100 has a cable side 101 at the first face 103 of the housing 105 and a male side 202 (see FIG. 2) at the second face 204 of the housing. As more fully explained hereinafter, a plurality of coaxial cables can be attached to cable ports on the cable side 101 of the connector 100, and plurality of female connectors can be attached to male ports on the male side 202 of the connector.

The connector 100 has a first set of eight (8) closely-spaced bores 111–118 extending into the housing 105 from the first face 103. The connector 100 has eight (8) circular cable ports 121–128 on the first face 103, one (1) at each bore 111–118, respectively. A connector assembly 106 includes connector 100, a cable adapter 120 and a clamp nut 130. Six (6) cable adapters 120 and six (6) clamp nuts 130 are shown removably attached to the housing 105 at cable ports 122–125 and 127–128. At cable port 121, one (1) additional cable adapter 120 and one (1) additional clamp nut 130 are shown in an exploded view with respect to the connector 100. Each coaxial cable 421–428 (see FIG. 4), which terminates in a respective cable adapter 120, is attachable to each cable port 121–128 of the connector 100. A respective clamp nut 130 removably secures the coaxial cable-cable adapter combination to each respective cable port 121–128 of the connector 100.

In one preferred embodiment, the housing 105 has a length of about 1.12-inch, a height of about 0.25-inch, and a width of about 0.45-inch. The connector 100 occupies less space than eight (8) prior art, single-position, coaxial cable-to-male, push-on connectors. Each bore 111–118 is spaced about 0.14-inch apart from an adjacent bore. Each bore 111–118 has internal threads 160. The internal threads 160 are nonstandard threads that are designed to permit a 0.01-inch wall in the housing 105 between adjacent bores 111–118. Preferably, the nonstandard internal threads 160 have a major diameter of about 0.130-inch, a minor diameter of 0.1165-inch to 0.1214-inch, and a pitch diameter of 0.1219-inch to 0.1242-inch, which dimensions are between the standard 5-80 thread and the standard 6-80 thread. The smaller standard 5-80 thread, and the requisite smaller diameter bores 111–118, would not allow sufficient wall thickness in the clamp nut 130, or if the wall in the clamp nut were made sufficiently thick, the smaller standard 5-80 thread would not allow enough room within the coupling nut for one of the coaxial cables 421–428, for the cable adapter 120 and for solder (not shown). The larger standard 6-80 thread, and the requisite larger diameter bores 111–118, would result in approximately zero wall thickness between adjacent cable bores 111–118 in the housing 105. The metallic housing 105 is preferably aluminum alloy 6061-T6, which is the preferred material for applications, such as aerospace applications, where weight reduction is important. Advantageously, one (1) connector 100 provides a weight savings compared to eight (8) prior art, single-position, coaxial cable-to-male, push-on connectors.

The housing 105 has two mounting holes 140–141, preferably countersunk holes, to allow the connector 100 to be securely fastened to another object, such as a bracket attached to a PWB. The housing has a key pin 150 protruding from the second face 204, which helps prevent a user from accidentally installing the connector 100 in a wrong location. Preferably, the key pin 150 is metallic, and more preferably, it is made of passivated CRES-410 or passivated CRES-420.

Figure 2:
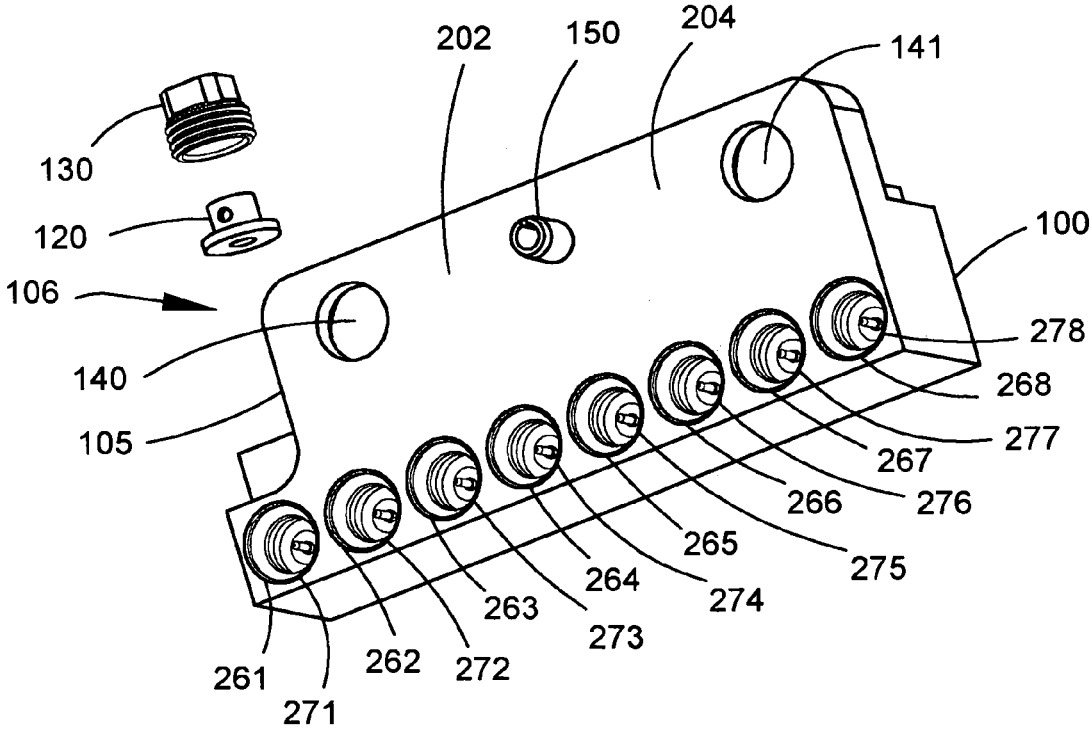
FIG. 2 is another perspective view of the eight-position, right-angle, coaxial cable-to-male, push-on connector of FIG. 1, showing the male ports.

FIG. 2 is another perspective view of the eight-position, right-angle, coaxial cable-to-male, push-on, connector 100, showing a second set of eight (8) closely spaced bores 261–268 at the second face 204 of the connector 100. The axis of each bore of the second set of bores 261–268 is at a right angle to the axis of each bore of the first set of bores 111–118. Corresponding pairs of bores from the first and second sets of bores join to form a set of right-angle junctions (see FIG. 3) within the housing 105. The connector 100 has eight (8) circular male ports 271–278, each having a push-on style interface, at each bore 261–268 on the second face 204 of the housing 105.

Figure 3:
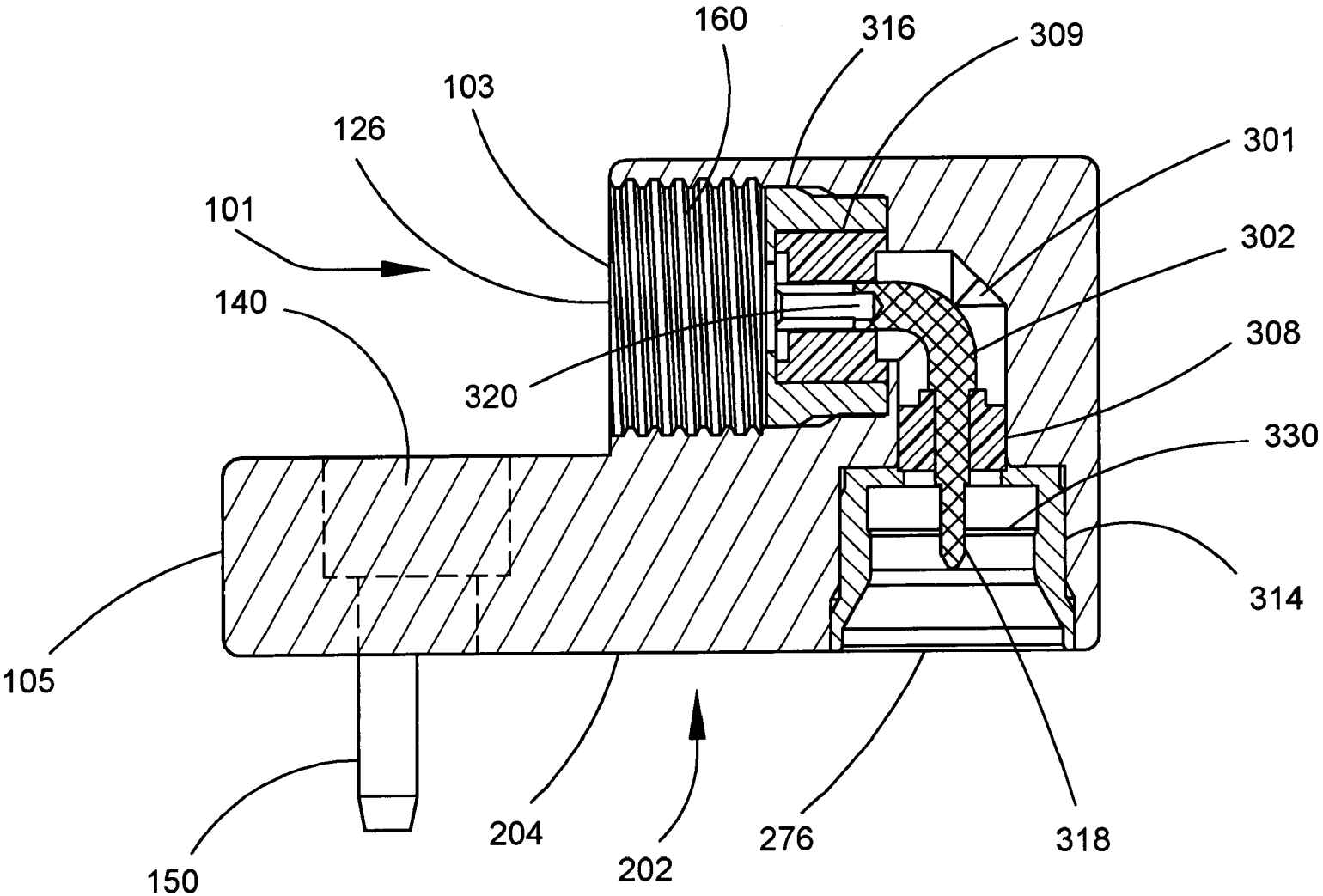
FIG. 3 is a cross-sectional view through cut-line 3—3 of FIG. 1.

FIG. 3 is a cross-sectional view through cut-line 3—3 of FIG. 1 showing the internal construction of a position formed by bore 116 and bore 266, which is representative of the eight (8) positions of connector 100. A right-angle junction 301 is formed where bore 116 meets bore 266. The position includes a metallic center contact 302 that is supported by two dielectrics 308 and 309. The preferred material for the dielectrics 308 and 309 is polytetrafluorethelene (PTFE). The dielectric 308 is held in place by a press-fit metallic shroud 314 near the male side 202 of the connector 100. The shroud 314 has a full detent 330. The dielectric 309 is held in place by a press-fit metallic bushing 316 near the cable side 101 of the connector. The center contact 302 terminates with a male pin 318 at the male side 202 of the connector 100 and terminates with a female socket contact 320 at the cable side 101 of the connector. The position shown in FIG. 3 shows cable port 126 on the cable side 101 of the connector 100 and male port 276 on the male side 202 of the connector.

Figure 4:
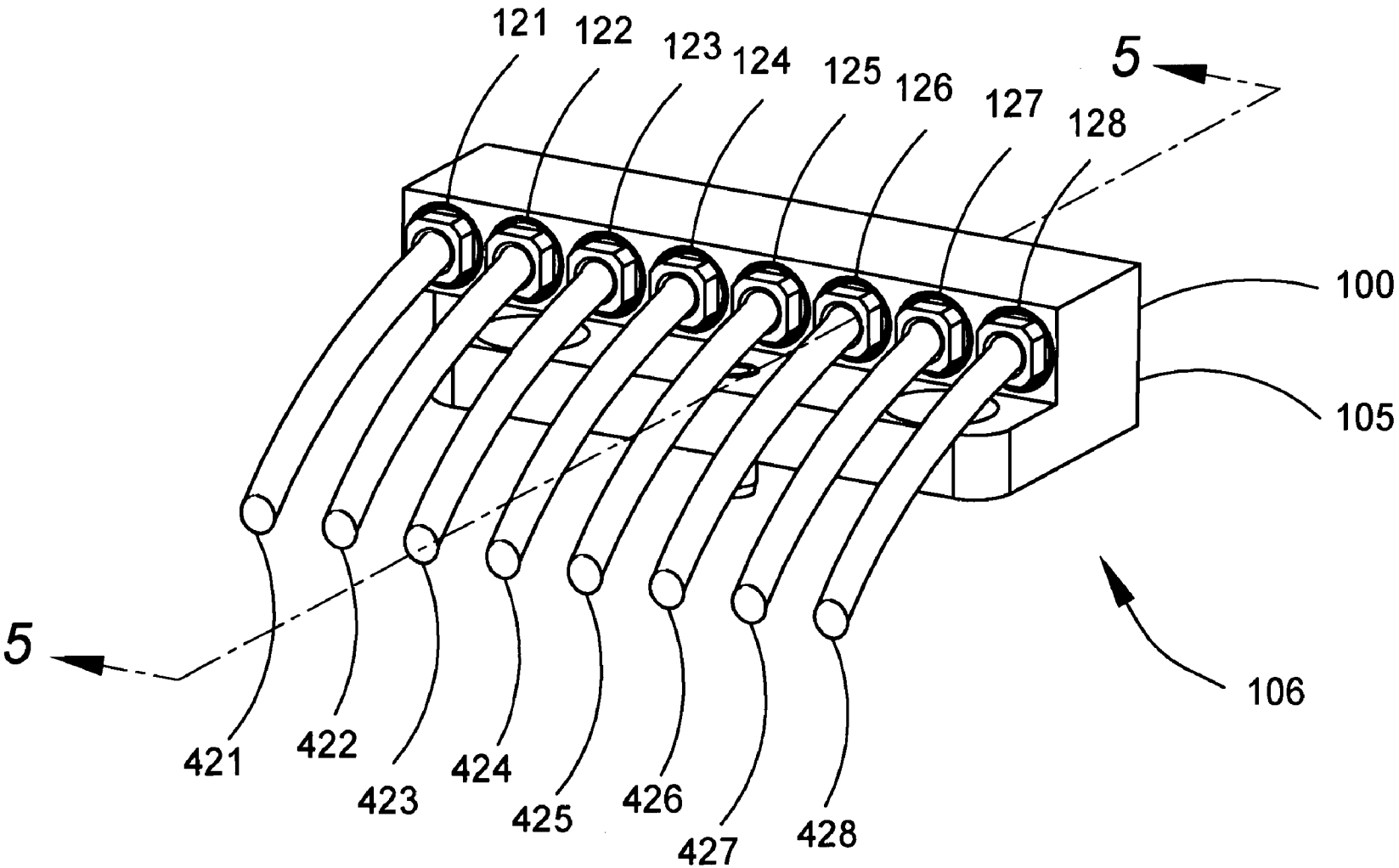
FIG. 4 is a perspective view of the eight-position, right-angle, coaxial cable-to-male, push-on connector of FIG. 1, including a coaxial cable connected to each cable port of the connector.

FIG. 4 is a perspective view of the connector 100, including a coaxial cable 421-428 removably attached to respective cable ports 121–128 of the connector.

Figure 5:
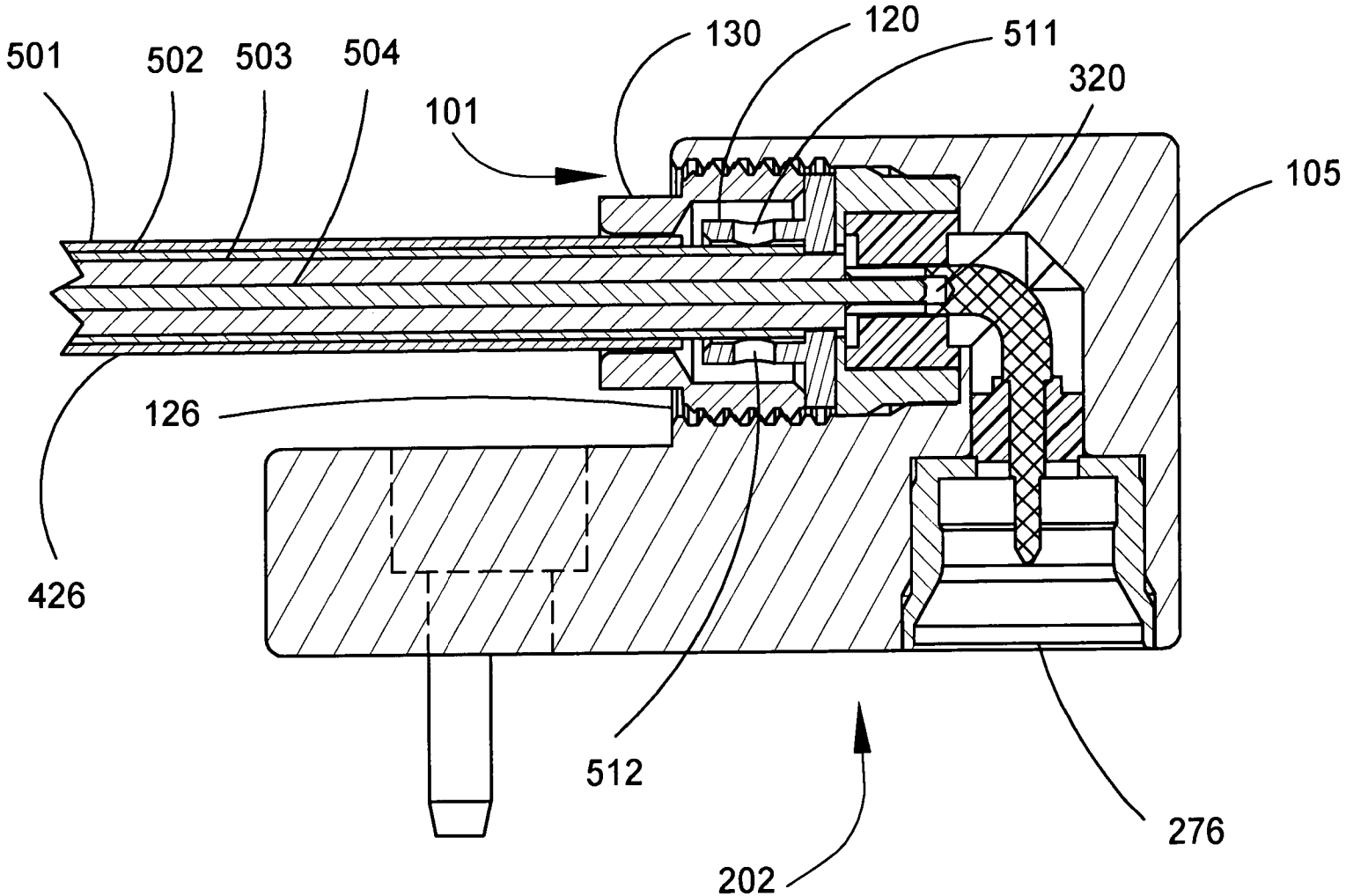
FIG. 5 is a cross-sectional view through cut-line 5—5 of FIG. 4.

FIG. 5 is a cross-sectional view through cut-line 5—5 of FIG. 4, showing a cross-sectional view of coaxial cable 426, which is representative of the coaxial cables 421–428. Prior to attaching the clamp nut 130 and the cable adapter 120 to the coaxial cable 426, the coaxial cable is prepared by selectively removing portions of the jacket 501, the outer conductor 502, and the insulation 503, near the end of coaxial cable to expose a center conductor 504 and the outer conductor 502, as shown in FIG. 5. Then, the clamp nut 130 is slid onto the coaxial cable 426 over its jacket 501. Next, the cable adapter 120 is soldered to the outer conductor 502 of the coaxial cable 426 at the two solder holes 511 and 512. The coaxial cable 426 with the attached cable adapter 120 ("coaxial cable-cable adapter combination") is then inserted into cable port 126 so that the center conductor 504 of the coaxial cable engages within the female socket contact 320 of the connector 100. Next, the clamp nut 130 is threaded into the housing 105 and is tightened with a torque tool 2000 (see FIGS. 20–22). FIGS. 4 and 5 show the completed attachment of the coaxial cable 426 to the connector 100. Because the cable adapter 120 is separate from the other portions of the connector 100, each coaxial cable 421–428 is individually field replaceable in the event that it should become worn or damaged.

Because the cable adapter 120 is separate from the other portions of the connector 100, the building and testing of cable assemblies is simplified in that there is no need to heat the housing 105 in order to solder the cables 421–428 to the cable adapters 120. Instead, the small thermal mass of the cable adapter 120 speeds up the soldering process. This arrangement also permits open inspection of the solder joint and offers an opportunity to fix any workmanship issues such as solder blobs or cable dielectric extrusion before attachment of each cable 421–428 to the connector 100.

Figure 6:
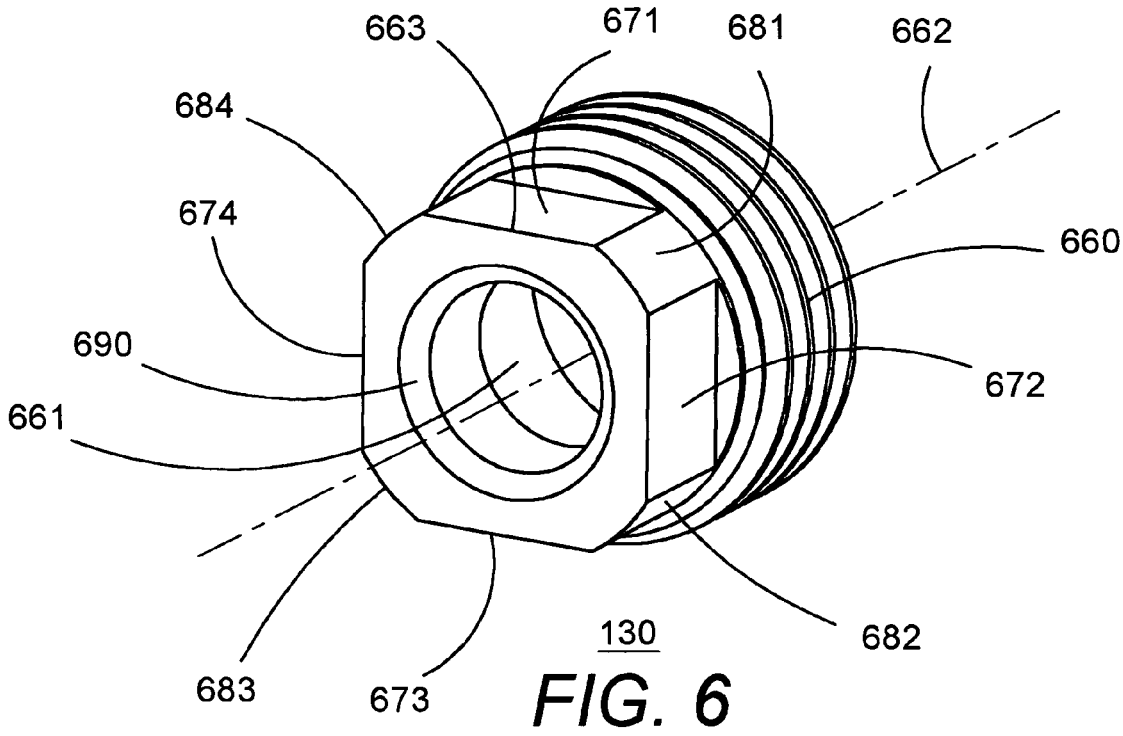
FIG. 6 is an enlarged perspective view of the clamp nut shown in FIG. 1.

FIG. 6 is an enlarged perspective view of the clamp nut 130. The clamp nut 130 has nonstandard external threads 660 that match the nonstandard internal threads 160 at the cable ports 121–128 of the connector 100. The clamp nut 130 has a cylindrical-shaped passageway 661 along a centerline 662 of the clamp nut for a coaxial cable to pass therethrough. The clamp nut 130 has a head 663 having four (4) flat sides 671–674 and having four (4) rounded corners 681–684 to better accommodate a torque tool 2000 (see FIG. 20). The head 663 of the clamp nut 130 has a rounded inside circular edge 690 at an entrance to the passageway 661. The rounded inside circular edge 690 acts as a coaxial cable strain relief.

Figure 7:
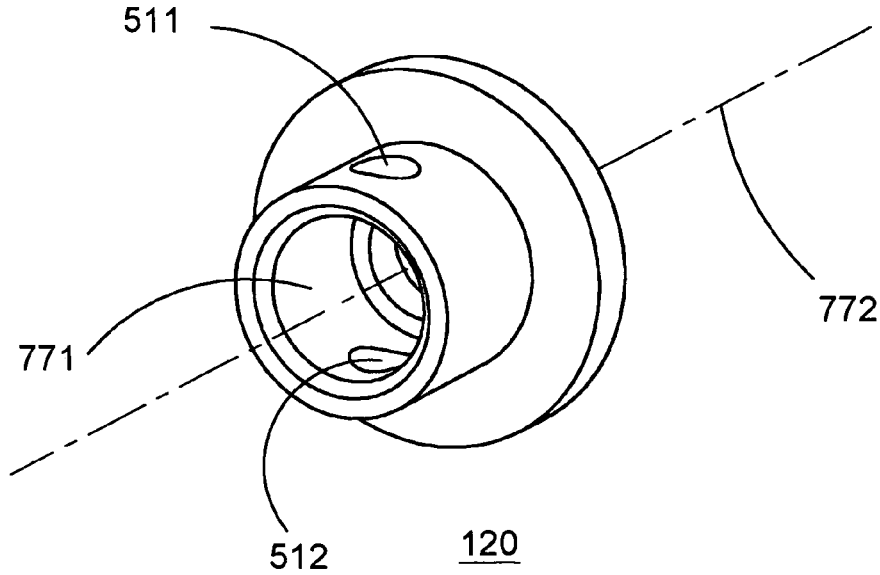
FIG. 7 is an enlarged perspective view of the cable adapter shown in FIG. 1.

FIG. 7 is an enlarged perspective view of the cable adapter 120. The cable adapter 120 has a cylindrical-shaped opening 771 along its centerline 772 for passage of one of the coaxial cables 421–428 that has been prepared, as explained herein above. Referring to both FIG. 7 and FIG. 5, the opening 771 has a larger diameter at the entrance of the cable adapter 120, which is the foreground of FIG. 7, than at the exit, in order to accommodate, at the entrance, a coaxial cable with its outer conductor 502 intact. The cable adapter 120 has two (2) solder holes 511–512 for application of solder in order to electrically and mechanically secure the outer conductor 502 of one of the coaxial cables 421–428 to the cable adapter.

Figure 8:
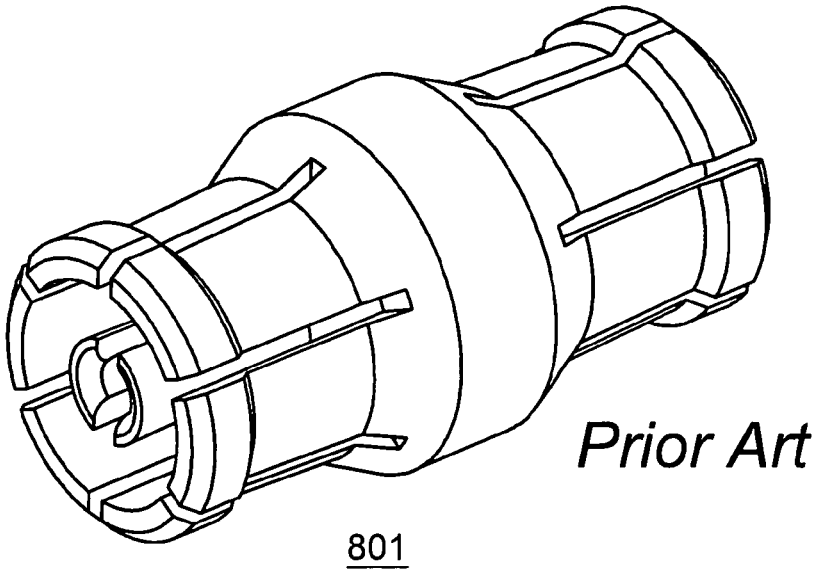
FIG. 8 is a perspective view of a typical known female-to-female bullet that is used to couple the male ports of two connectors.
Figure 10:
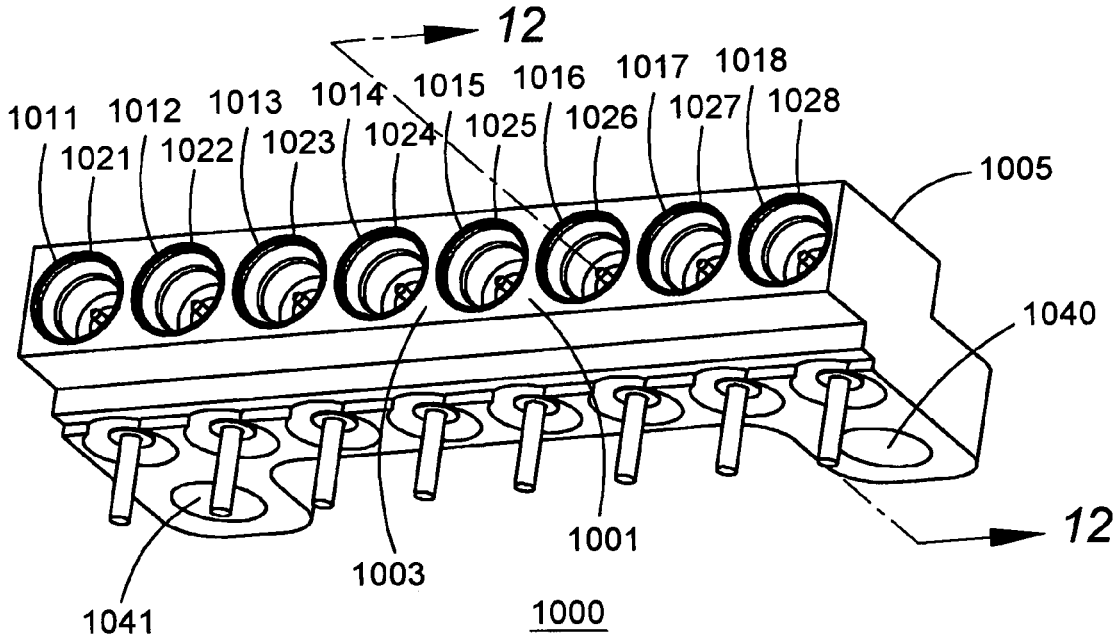
FIG. 10 is a perspective view of an eight-position, right-angle, push-on, male-to-PWB connector.

FIG. 8 is a perspective view of a known push-on, female-to-female connector, or bullet, 801, catalog number B1B1-0001-01, manufactured by Corning Gilbert, Inc., which is used to couple the male ports of two connectors, such as connector 100 and connector 1000 (see FIG. 10). A coaxial cable-to-PWB connector system 1300 (see FIG. 13) in accordance with the invention comprises the connector 100 and the connector 1000 coupled by eight (8) of the female-to-female bullets 801. The coaxial cable-to-PWB connector system 1300 allows the multi-position, coaxial cable-to-male connector 100 to be connected to the multi-position, male-to-PWB connector 1000 via means for compensating for axial or radial, or both axial and radial misalignment of corresponding positions on the connectors.

Figure 9:
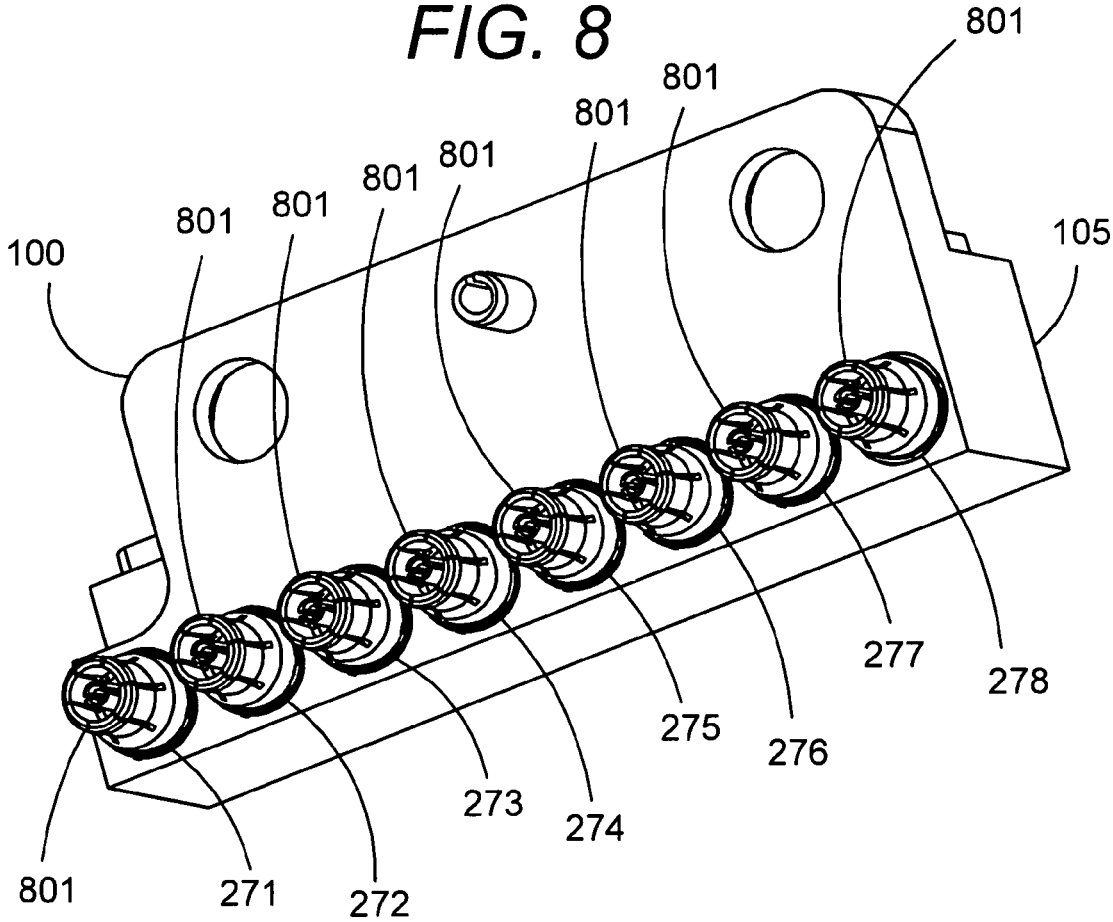
FIG. 9 is a perspective view of the eight-position, right-angle, coaxial cable-to-male, push-on connector of FIG. 2, including the female-to-female bullet of FIG. 8 attached to each male port of the connector.

FIG. 9 is a perspective view of the connector 100, including one (1) female-to-female bullet 801 attached to each male, push-on port 271–278 of the connector. As the number of positions on a pair of connectors increases, the probability increases that one or more positions on one connector 100 or 1000 will be radially or axially, or both radially and axially, misaligned with a corresponding position on the other connector 100 or 1000. The coaxial cable-to-PWB connector system 1300 in accordance with the invention allows the connectors 100 and 1000 to be coupled to each other in spite of axial or radial, or both axial and radial, misalignment because the bullets can gimbal to accommodate such misalignment. Advantageously in a preferred embodiment, when installed in the male ports of the connectors 100 and 1000, the female-to-female bullets 801 gimbal 0.01-inch radially and 0.01-inch axially, with respect to the connector in which it is installed.

FIG. 10 is a perspective view of an eight-position, right-angle, push-on, male-to-PWB connector 1000. Each position of the connector 1000 comprises one male port and one PWB port. The connector 1000 comprises a housing 1005, preferably a metallic housing. The housing 1005 has a first face 1003 and a second face 1104 (see FIG. 11). The plane of the second face 1104 is at a right angle to the plane of the first face 1003. Each position of the connector 1000 comprises one male port and one PWB port. The connector 1000 has a male side 1001 at the first face 1003 of the housing 1005 and a PWB side 1102 (see FIG. 11) at the second face 1104 of the housing. The connector 1000 has a first set of eight (8) closely-spaced bores 1011–1018 extending into the housing 1005 from the first face 1003. The connector 1000 has eight (8) male, push-on ports 1021–1028 on the first face 1003, one (1) at each bore 1011–1018, respectively. The housing 1005 has two mounting holes 1040–1041 to allow the connector 1000 to be securely fastened to a PWB.

Figure 11:
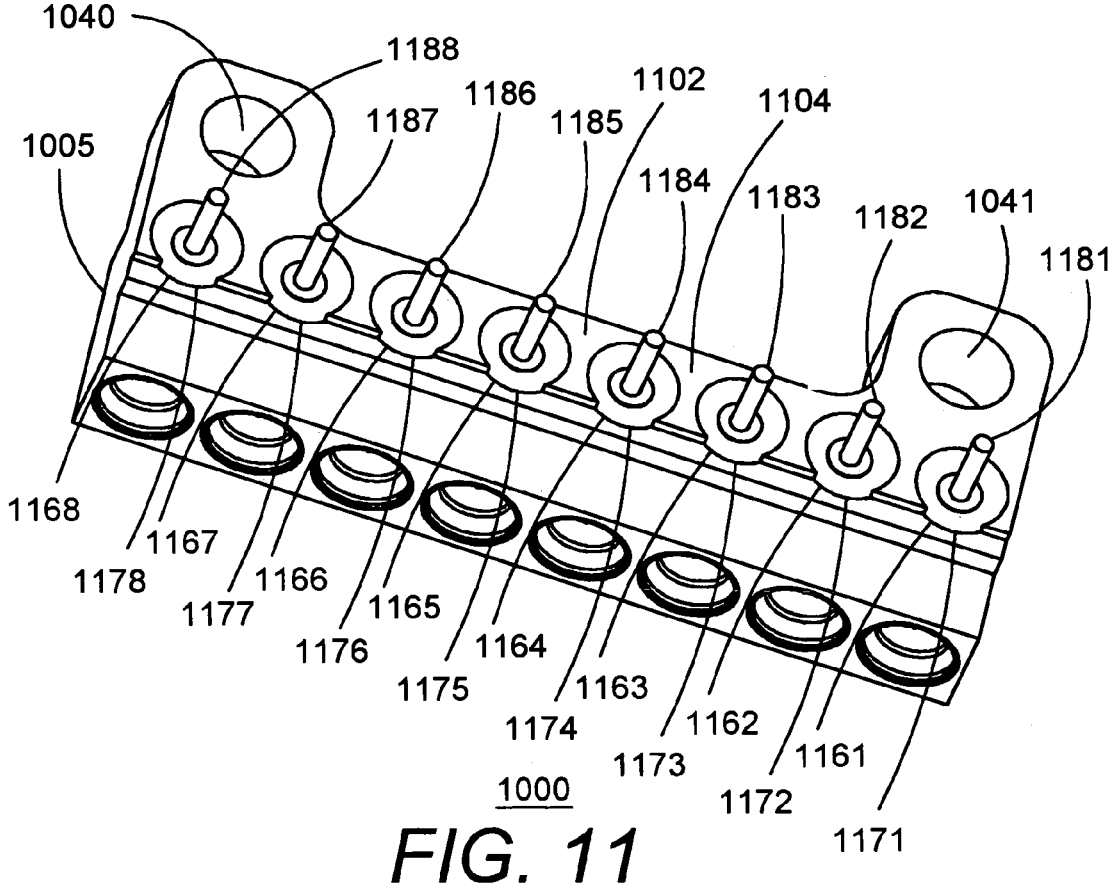
FIG. 11 is another perspective view of the eight-position, right-angle, push-on, male-to-PWB connector of FIG. 10.

FIG. 11 is another perspective view of the eight-position, right-angle, push-on, male-to-PWB connector 1000, showing a second set of eight (8) closely spaced bores 1161–1168 at the second face 1104 of the connector 1000. The axis of each bore of the second set of bores 1161–1168 is at a right angle to the axis of each bore of the first set of bores 1011–1018. Corresponding pairs of bores from the first and second sets of bores join to form a set of right-angle junctions (see FIG. 12) within the housing 1005. The connector 1000 has eight (8) PWB ports 1171–1178 on the second face 1104 of the housing 1005, one (1) PWB port at each bore 1161–1168, respectively. Each PWB port 1171–1178 comprises a straight PWB pin 1181–1188. In a preferred embodiment, the housing 1005 of the connector 1000 has a length of about 1.12-inch, a height of about 0.25-inch, and a width of about 0.45-inch. Each cable port is spaced apart about 0.14-inch. The connector 1000 occupies less space than eight (8) known, single-position, right-angle, push-on, male-to-PWB connectors. For example, eight (8) known, single-position, GPPO Right Angle PCB Mount connectors, catalog number B009-P33-01, manufactured by Corning Gilbert, Inc., of Glendale, Ariz., occupy a larger space having a total length of 1.23-inch, assuming that there are seven (7) small 0.01-inch spaces between each of the eight (8) single-position connectors. Advantageously, one (1) connector 1000 provides a weight savings compared to eight (8) known, single-position, right-angle, push-on, male-to-PWB connectors.

Figure 12:
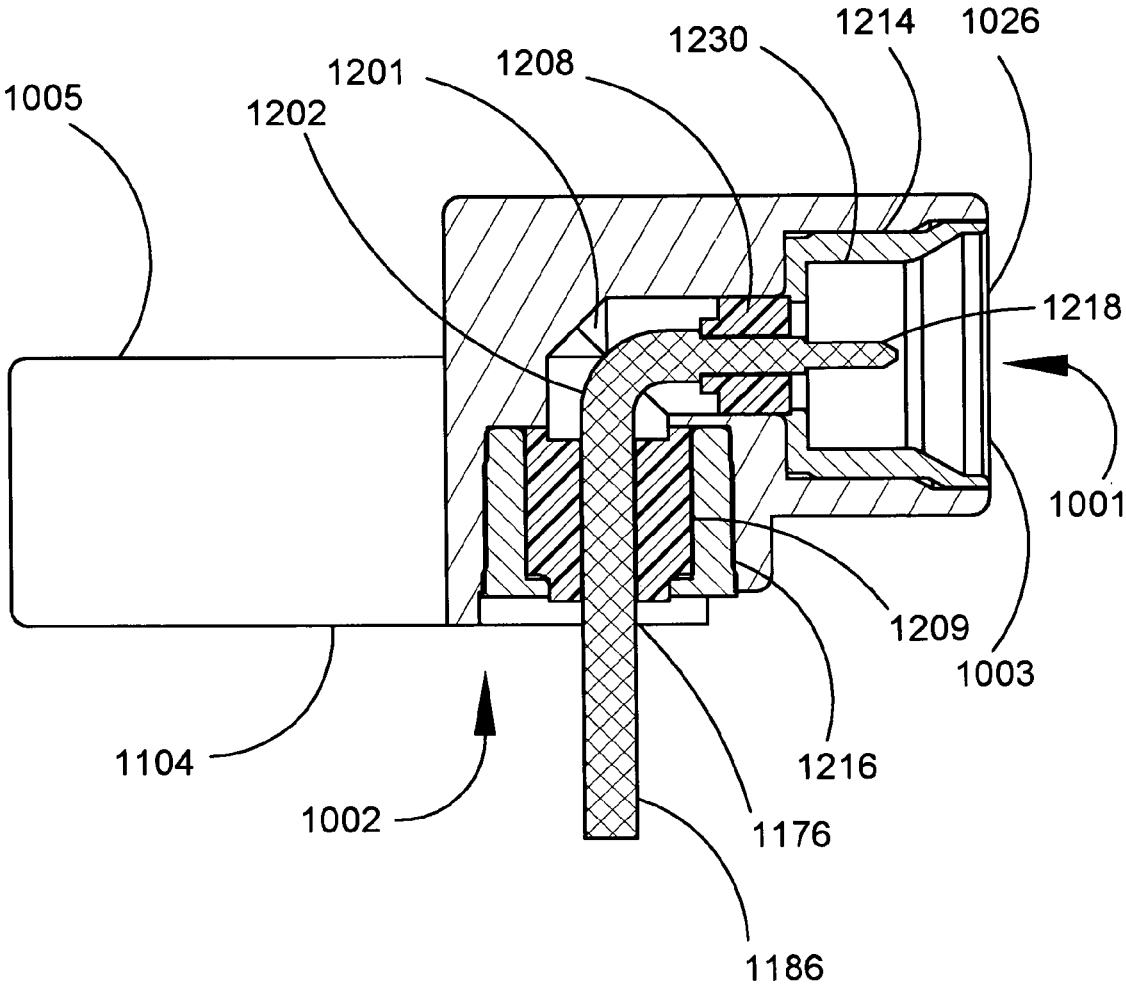
FIG. 12 is a cross-sectional view through cut-line 12—12 of FIG. 10.

FIG. 12 is a cross-sectional view through cut-line 12—12 of FIG. 10 showing the internal construction of a position formed by bore 1016 and bore 1166, which is representative of the eight (8) positions of connector 1000. A right-angle junction 1201 is formed where bore 1016 meets bore 1166. The position includes a metallic center contact 1202 that is supported by two dielectrics 1208 and 1209. The preferred material for the dielectrics 1208 and 1209 is polytetrafluorethelene (PTFE). The dielectric 1208 is held in place by a press-fit metallic shroud 1214 near the male side 1001 of the connector 1000. The shroud 1214 advantageously lacks a detent and preferably has a smooth bore 1230. The dielectric 1209 is held in place by a press-fit metallic bushing 1216 near the PWB side 1102 of the connector 1000. The center contact 1202 terminates with a metallic male pin 1218 at the male side 1001 of the connector 1000 and terminates with a straight PWB pin 1186 that protrudes from the PWB side 1102 of the connector. The position shown in FIG. 12 shows male port 1026 on the male side 1001 of the connector 1000 and PWB port 1176 on the PWB side 1102 of the connector.

Figure 13:
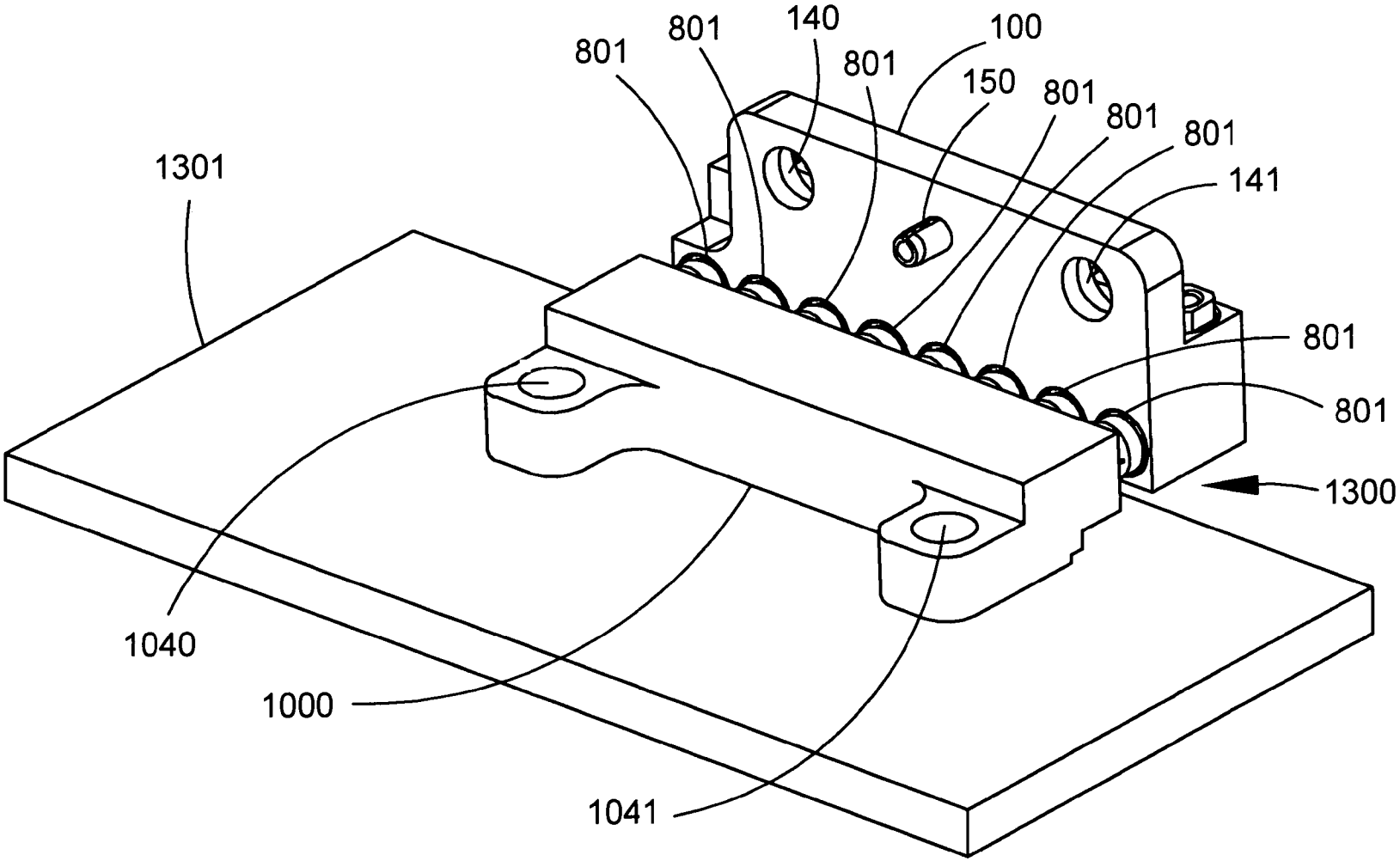
FIG. 13 is a perspective view of the connector of FIGS. 1 and 2 mated to the connector of FIGS. 10 and 11 using the female-to-female bullets of FIG. 8, including a PWB to which the eight-position, right-angle, male-to-PWB connector is attached.

FIG. 13 is a perspective view of the coaxial cable-to-male connector 100 mated to the male-to-PWB connector 1000 using eight (8) of the female-to-female bullets 801, thereby forming the coaxial cable-to-PWB connector system 1300. The male-to-PWB connector 1000 is mounted to a PWB 1301. The coaxial cable-to-PWB connector system 1300 allows a user to make and break a plurality of coaxial cable-to-PWB connections with a single action. The coaxial cable-to-PWB connector system 1300 allows the multi-position, male-to-PWB connector to be disconnected from the multi-position, coaxial cable-to-male connector 100 with the plurality of female-to-female bullets 801 remaining on the coaxial cable-to-male connector, as shown in FIG. 9. The female-to-female bullets 801 remain on the coaxial cable-to-male connector 100 because the male ports 171–178 of the coaxial cable-to-male connector 100 have full detents 330. On the other hand, the male ports 1071–1078 of the male-to-PWB connector 1000 lack detents. It is advantageous that the female-to-female bullets 801 remain on the coaxial cable-to-male connector 100 because this feature increases the accessibility of the female-to-female bullets when the male-to-PWB connector 1000 is mounted on the PWB 1301 that has been installed inside an enclosure. A user disconnects the coaxial cable-to-male connector 100 from the male-to-PWB connector 1000 and brings the coaxial cable (with the coaxial cable-to-male connector attached thereto) outside the enclosure where it is easier to replace the bullets 801, if replacement is needed. As explained above, the coaxial cable-to-PWB connector system 1300 in accordance with the invention allows multiple coaxial cable-to-PWB connections to be made or broken with a single action, and eliminates PWB tolerance stack ups. The male-to-PWB connector 1000 allows increased connection density and a smaller PWB footprint. The male-to-PWB connector 1000 also allows stronger attachment to the PWB 1301 because use of the mounting holes and a larger solder surface area (compared to single-position connectors), help prevent pad liftoff from the PWB. The coaxial cable-to-PWB connector system 1300 simplifies assembly, reduces or eliminates chances of mis-wiring, and simplifies cable harness management.

Figure 14:
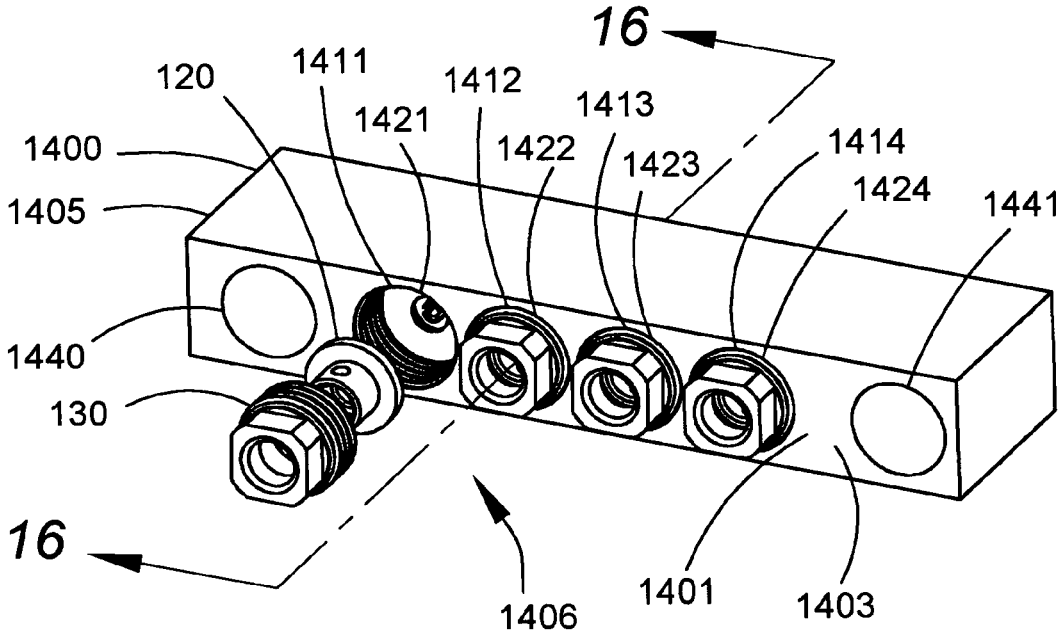
FIG. 14 is a perspective view of a four-position, straight, coaxial cable-to-male, push-on connector including a cable adapter and a clamp nut at each cable port, and including an exploded view at one of the cable ports.

FIG. 14 is a perspective view of a four-position, straight, coaxial cable-to-male, push-on, connector 1400. Each position of the connector 1400 comprises one cable port and one male port. The connector 1400 comprises a housing 1405, preferably a metallic housing. The housing 1405 has a first face 1403 and a second face 1504 (see FIG. 15). The plane of the second face 1504 is approximately parallel to the plane of the first face 1403. Each position of the connector 1400 comprises one cable port and one male port. The connector 1400 has a cable side 1401 at the first face 1403 of the housing 1405 and a male side 1502 (see FIG. 15) at the second face 1504 of the housing. The connector 1400 has a set of four (4) closely-spaced bores 1411–1414 extending through the housing 1405 between the first face 1403 and the second face 1504. The axis of each bore 1411–1414 is at a right angle to the planes of the first face 1403 and the second face 1504. The connector 1400 has four (4) circular cable ports 1421–1424 on the first face 1403, one (1) at each bore 1411–1414. Connector assembly 1406 includes the aforementioned connector 1400 along with four (4) cable adapters 120 and four (4) clamp nuts 130. Three (3) cable adapters 120 and three (3) clamp nuts 130 are shown removably attached to the housing 1405 at cable ports 1422–1424. At cable port 1421, one (1) cable adapter 120 and one (1) clamp nut 130 are shown in an exploded view with respect to the connector 1400. The housing 1405 has two mounting holes 1440–1441, to allow the connector 1400 to be securely fastened to another object, such as a bracket on a PWB.

Figure 15:
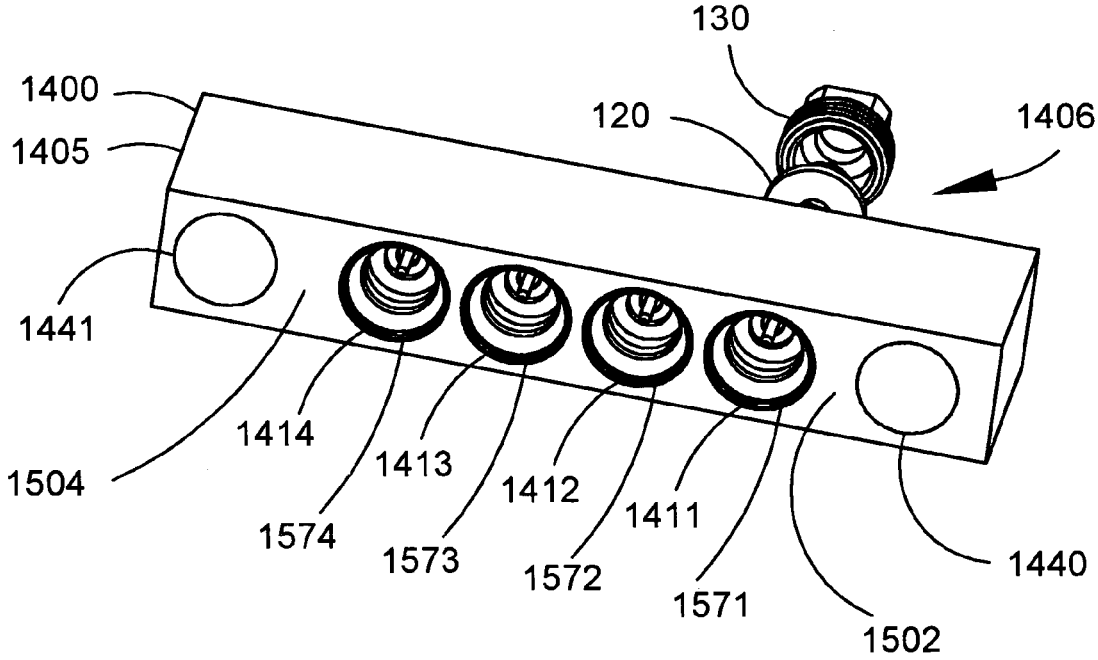
FIG. 15 is another perspective view of the four-position, straight, coaxial cable-to-male, push-on connector of FIG. 14, showing the male ports.

FIG. 15 is another perspective view of the four-position, straight, coaxial cable-to-male, push-on, connector 1400, showing the set of four (4) bores 1411–1414 at the second face 1504 of the connector 1400. The connector 1400 has four (4) circular male, ports 1571–1574, each having a push-on style interface, at each bore 1411–1414, respectively, on the second face 1504 of the housing 1405. In a preferred embodiment, the housing 1405 of the connector 1400 has a length of about 0.96-inch, a height of about 0.152-inch, and a width of about 0.248-inch. Each coaxial port is spaced apart 0.14-inch. The connector 1400 occupies less space than four (4) known, single-position, straight, coaxial cable-to-male, push-on connectors. Advantageously, one (1) connector 1400 provides a weight savings compared to four (4) known, single-position, straight, coaxial cable-to-male, push-on connectors.

Figure 16:
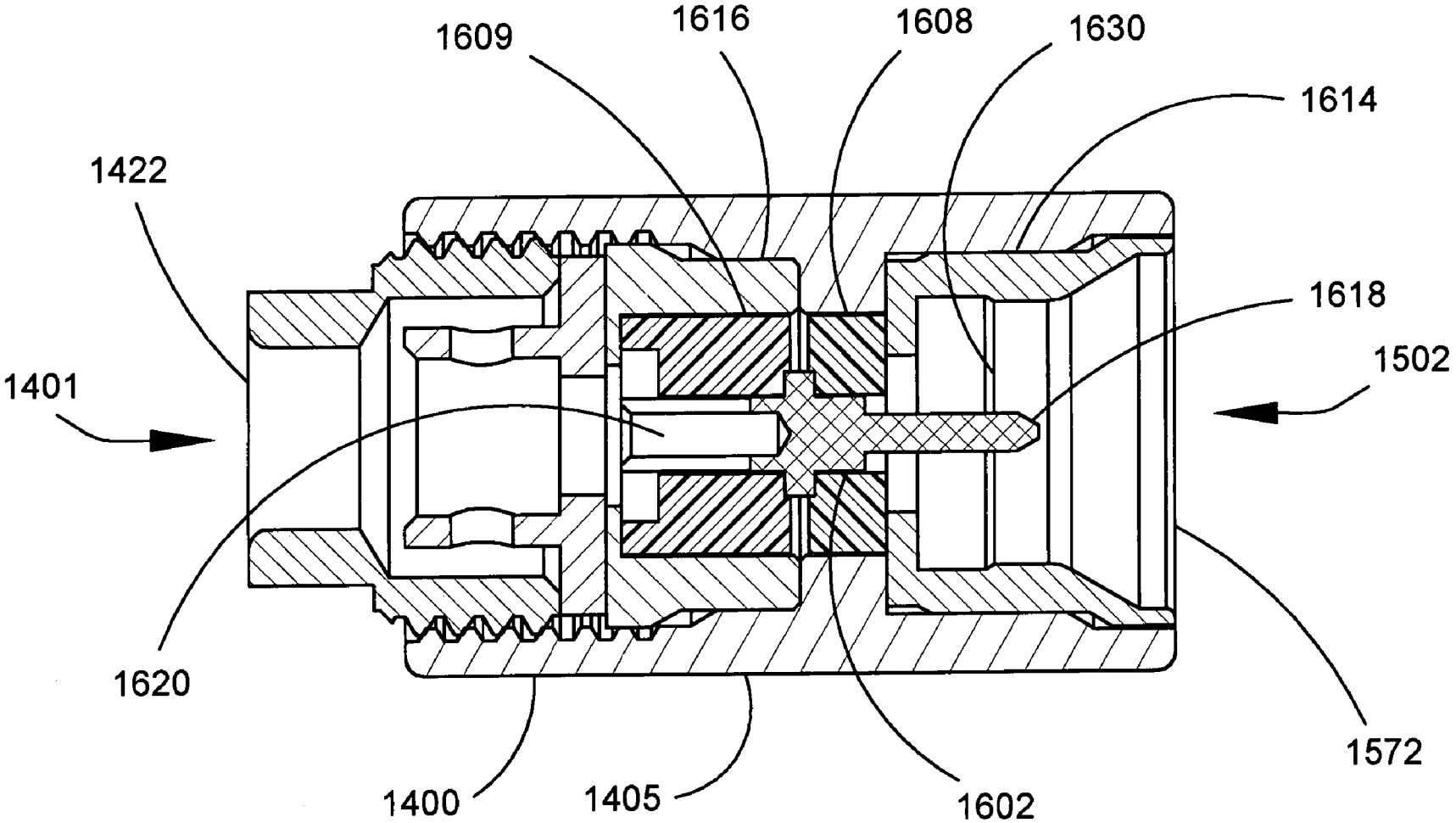
FIG. 16 is a cross-sectional view through cut-line 16—16 of FIG. 14.

FIG. 16 is a cross-sectional view through cut-line 16—16 of FIG. 14 showing the internal construction of a position formed by bore 1412, which is representative of the four (4) positions of connector 1400. The position includes a metallic center contact 1602 that is supported by two dielectrics 1608 and 1609. The preferred material for the dielectrics 1608 and 1609 is polytetrafluorethelene (PTFE). The dielectric 1608 is held in place by a press-fit metallic shroud 1614 near the male side 1502 of the connector 1400. The dielectric 1609 is held in place by a press-fit metallic bushing 1616 near the cable side 1401 of the connector 1400. The shroud 1614 has a full detent 1630 for securely holding a female-to-female bullet 801. The center contact 1602 terminates with a male pin 1618 at the male side 1502 of the connector 1400 and terminates with a female socket contact 1620 at the cable side 1401 of the connector. The position shown in FIG. 16 shows cable port 1422 on the cable side 1401 of the connector 1400 and male port 1572 on the male side 1502 of the connector.

Figure 17:
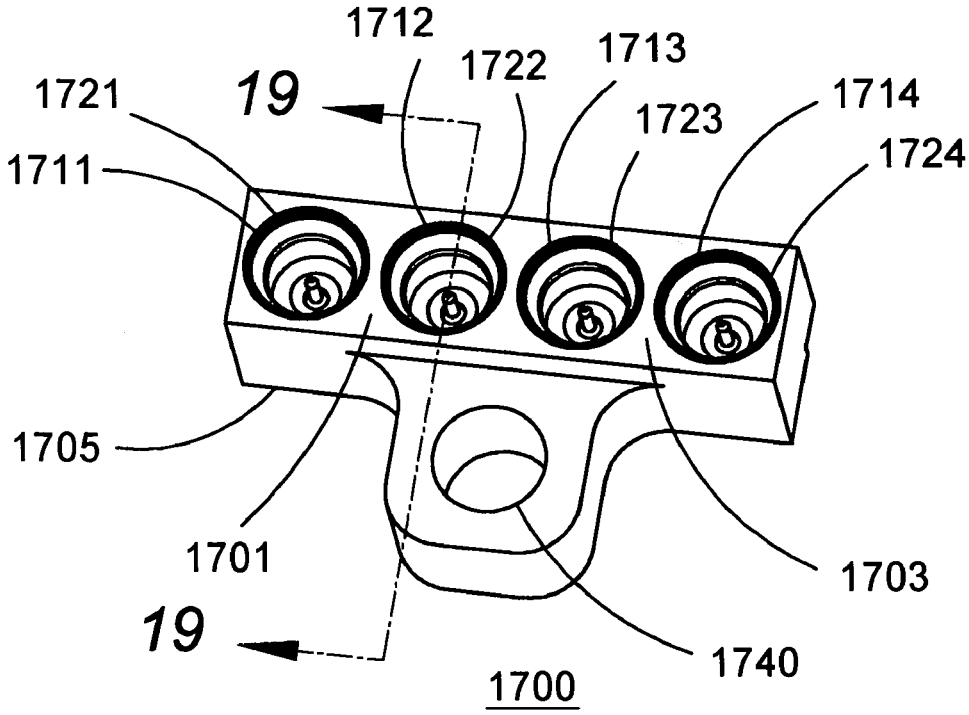
FIG. 17 is a perspective view of a four-position, straight, push-on, male-to-PWB connector.

FIG. 17 is a perspective view of a four-position, straight, push-on, male-to-PWB connector 1700. Each position of the connector 1700 comprises one male port and one PWB port. The connector 1700 comprises a housing 1705, preferably a metallic housing. The housing 1705 has a first face 1703 and a second face 1804 (see FIG. 18). The plane of the second face 1804 is approximately parallel to the plane of the first face 1703. Each position of the connector 1700 comprises one male port and one PWB port. The connector 1700 has a male side, 1701 at the first face 1703 of the housing 1705 and a PWB side 1802 (see FIG. 18) at the second face 1804 of the housing. The connector 1700 has a set of four (4) closely-spaced bores 1711–1714 extending through the housing 1705 between the first face 1703 and the second face 1804. The axis of each bore 1711–1714 is at a right angle to the planes of the first face 1703 and the second face 1804. The connector 1700 has four (4) male, push-on ports 1721–1724 on the first face 1703, one (1) at each bore 1711–1714. The housing 1705 has a mounting hole 1740 to allow the connector 1700 to be securely fastened to a PWB.

Figure 18:
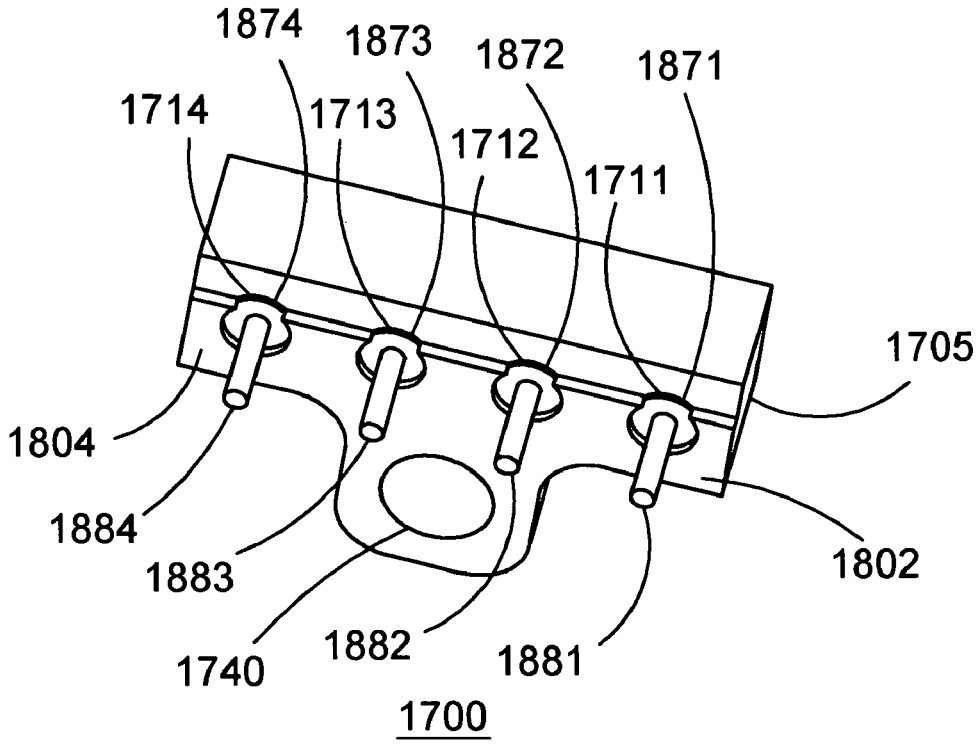
FIG. 18 is another perspective view of the four-position, straight, push-on, male-to-PWB connector of FIG. 17.

FIG. 18 is another perspective view of the four-position, straight, push-on, male-to-PWB connector 1700, showing the set of four (4) bores 1711–1714 at the second face 1804 of the connector 1700. The connector 1700 has four (4) PWB ports 1871–1874, one (1) at each bore 1711–1714 on the second face 1804 of the housing 1705. Each PWB port 1871–1874 comprises a straight PWB pin 1881–1884. In a preferred embodiment, the housing of the connector 1700 has a length of about 0.56-inch, a height of about 0.16-inch, and a width of about 0.35-inch. Each cable port is spaced apart 0.14-inch. The connector 1700 occupies less space than four (4) known, single-position, straight, push-on, male-to-PWB connectors. For example, four (4) known, single-position GPPO PCB Mount connectors, catalog number B008-L13–01, manufactured by Corning Gilbert, Inc., occupy a larger space having a height of 0.194-inch and having a total length of 0.61-inch, assuming that there are three (3) small 0.01-inch spaces between the four (4) single-position connectors. Advantageously, one (1) connector 1700 provides a weight savings compared to four (4) known, single-position, straight, push-on, male-to-PWB connectors. The coaxial cable-to-PWB connector system 1300 alternatively comprises connector 1400 and connector 1700 coupled by four (4) of the female-to-female bullets 801.

Figure 19:
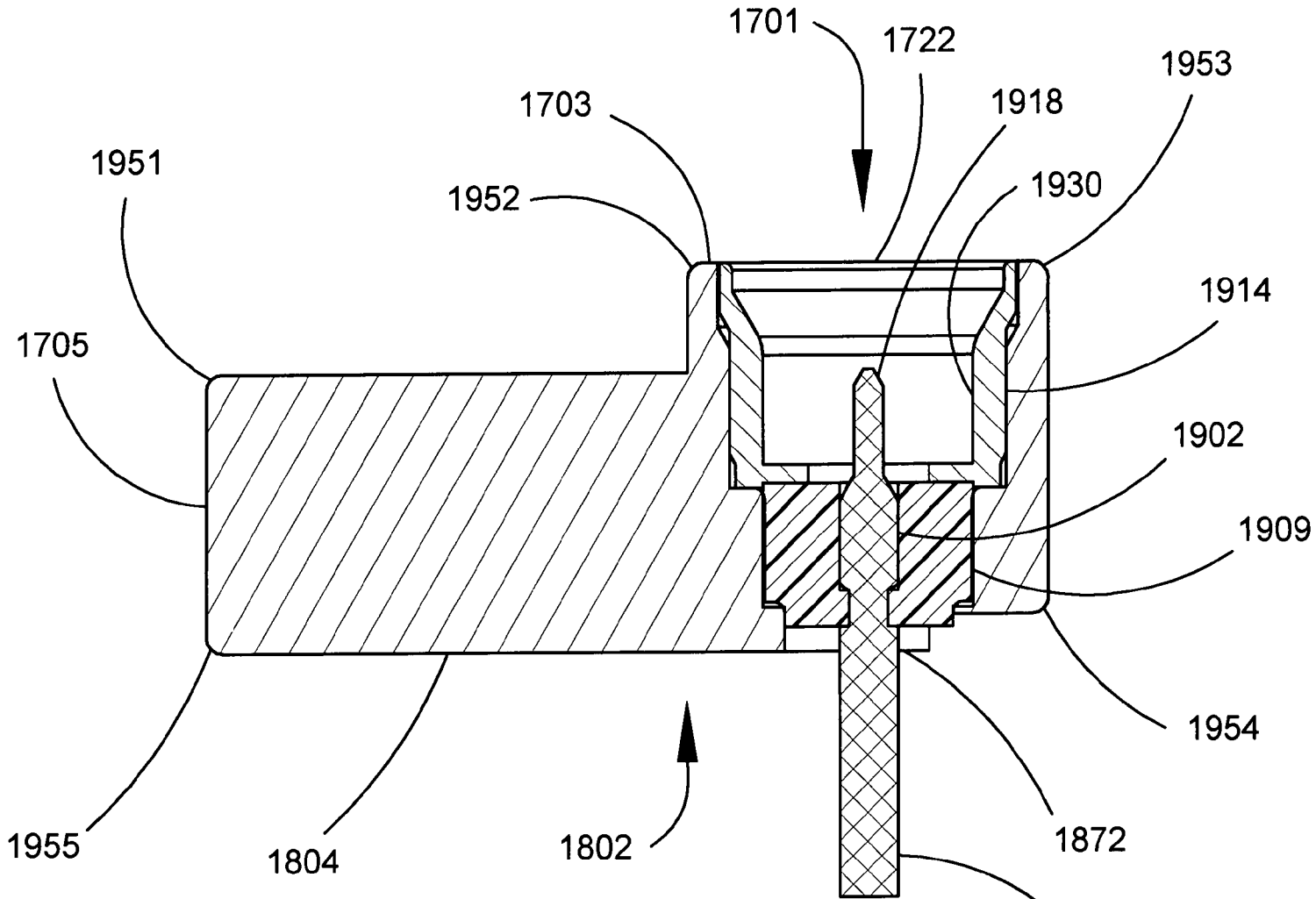
FIG. 19 is a cross-sectional view through cut-line 19—19 of FIG. 17.

FIG. 19 is a cross-sectional view through cut-line 19—19 of FIG. 17 showing the internal construction of a position formed by bore 1712, which is representative of the four (4) positions of connector 1700. The position includes a metallic center contact 1902 that is supported by a dielectric 1909. The preferred material for the dielectric 1909 is polytetrafluorethelene (PTFE). The dielectric 1909 is held in place by a press-fit metallic shroud 1914 near the male side 1701 of the connector 1700. The shroud 1914 advantageously lacks a detent and has a smooth bore 1930. The center contact 1902 terminates with a male pin 1918 at the male side 1701 of the connector 1700 and terminates with the straight PWB pin 1882 that protrudes from the PWB side 1802 of the connector. The position shown in FIG. 19 shows male port 1722 on the male side 1701 of the connector 1400 and PWB port 1872 on the PWB side 1802 of the connector.

Known aluminum connector housings have a number of sharp outside edges that will sometimes become nicked while being tumbled during a plating operation. The connectors 100, 1000, 1400 and 1700 in accordance with the invention have outer corners (for example, corners 1951–1955 of connector 1700) that are rounded to a radius of approximately 0.01-inch. Preferably, the aluminum housing 105, 1005, 1405, 1705 of the connectors 100, 1000, 1400 and 1700 is gold plated to improve solderability, low contact resistance, and corrosion protection. Advantageously, the rounded outer edges of the connectors 100, 1000, 1400 and 1700 help to prevent nicks from occurring at the edges while the connectors are being tumbled during a gold-plating operation. Note that in the drawings, the rounded outer edges are shown only in the cross-sectional views of the connectors, which are enlargements of the perspective views of the connectors.

Figure 20:
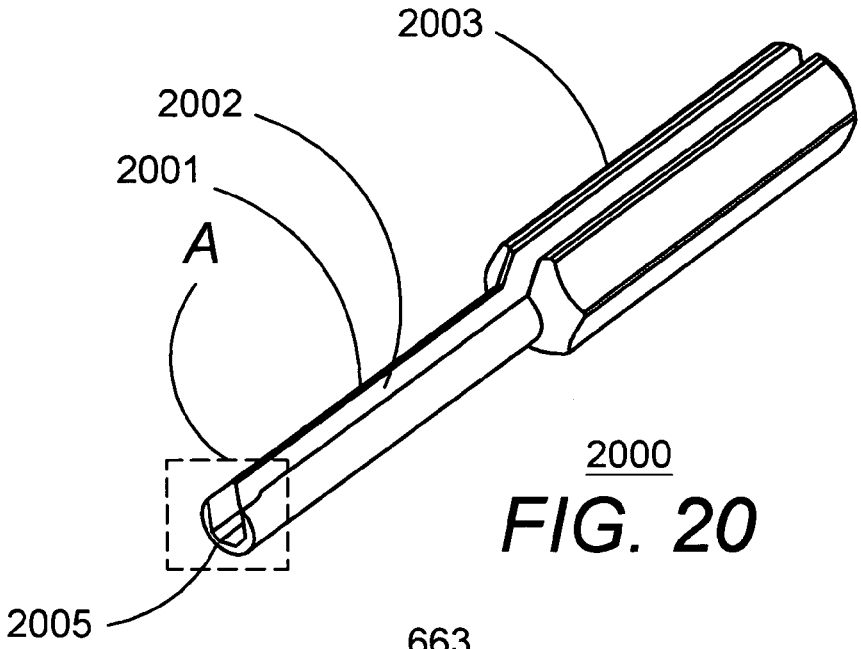
FIG. 20 is a perspective view of a torque tool that is used to tighten the clamp nuts on the coaxial cable connectors.

FIG. 20 is a perspective view of a torque tool 2000 that is used to tighten the clamp nuts 130 on the cable connectors 100 and 1400. Preferably, the torque tool 2000 is metallic for strength. The torque tool comprises an elongated hollow segment 2001, a handle 2003 at one end adapted for attachment to a standard ¼-inch hex tool, and a tip 2005 at another end opposite the handle. The torque tool 2000 has a slot 2002 extending longitudinally from the tip 2005 to at least the handle 2003. The slot 2002 has a width that is slightly larger than the diameter of one of the coaxial cables 421–428, thereby allowing a coaxial cable to pass therethrough. The elongated hollow segment 2001 has an outer diameter at the tip 2005 that is advantageously small enough to fit between closely-spaced, clamp nuts 130 at adjacent cable ports 121–128.

Figure 21:
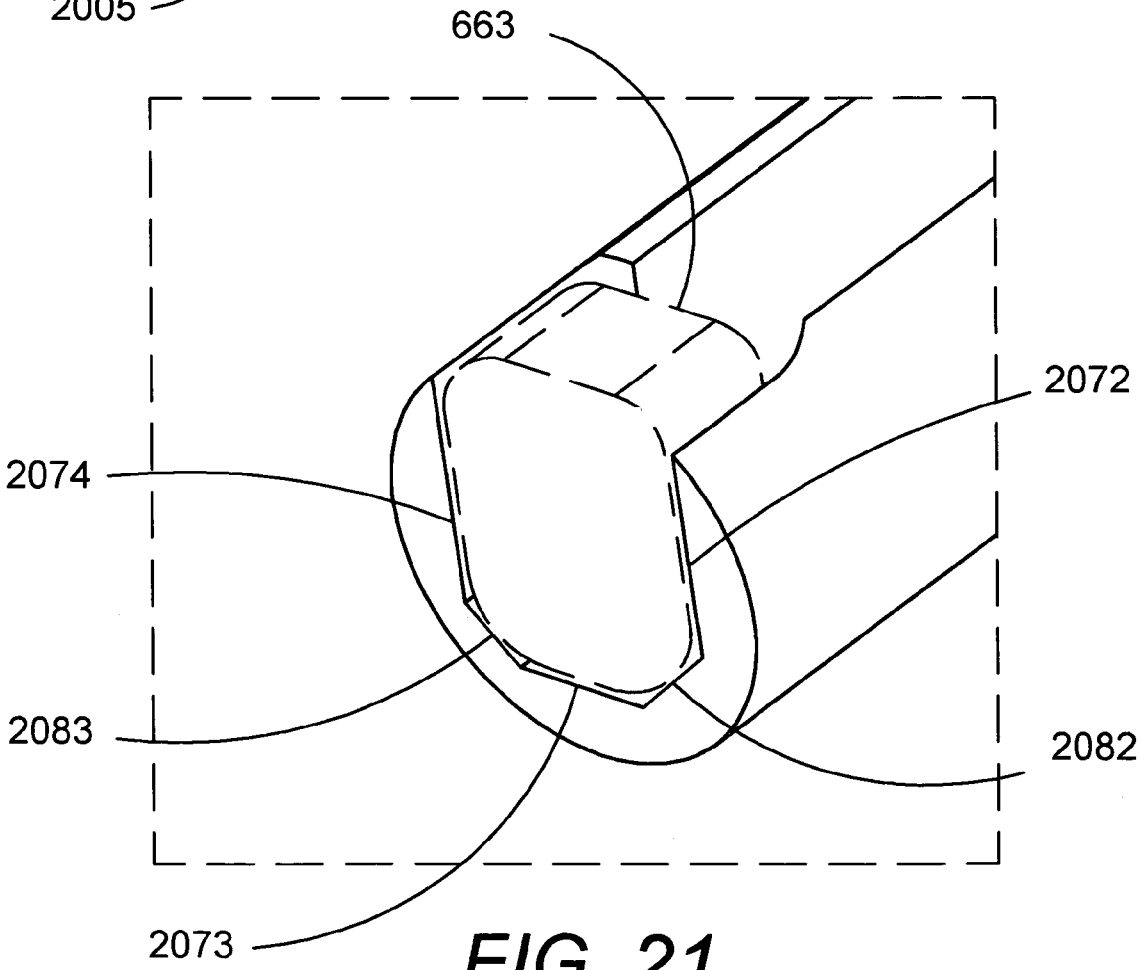
FIG. 21 is an enlargement of Area A of FIG. 20.

FIG. 21 is an enlargement of Area A of FIG. 20, including the head 663 of a clamp nut 130 (shown in dotted lines). The inside of the tip 2005 of the torque tool 2000 has three (3) flat surfaces 2072–2074 corresponding to three (3) of the four (4) flat sides 671–674 of the head 663 of the clamp nut 130. The inside of the tip 2005 of the torque tool 2000 also has two 45° chamfers 2082 and 2083 corresponding to two (2) of the four (4) rounded corners 681–684 of the head 663 of the clamp nut 130. Because the head 663 of the clamp nut 130 has four (4) rounded corners 681–684 rather than sharp corners, the torque tool 2000 can advantageously be constructed with the two 45° chamfers 2082 and 2083. Consequently, the torque tool 2000 can have thicker, stronger walls at the areas of the tip 2005 that contact the rounded corners 681-684 of the head 663 of the clamp nut 130, which are the areas where strength is most needed, without increasing the outer diameter of the elongated hollow segment 2001.

Figure 22:
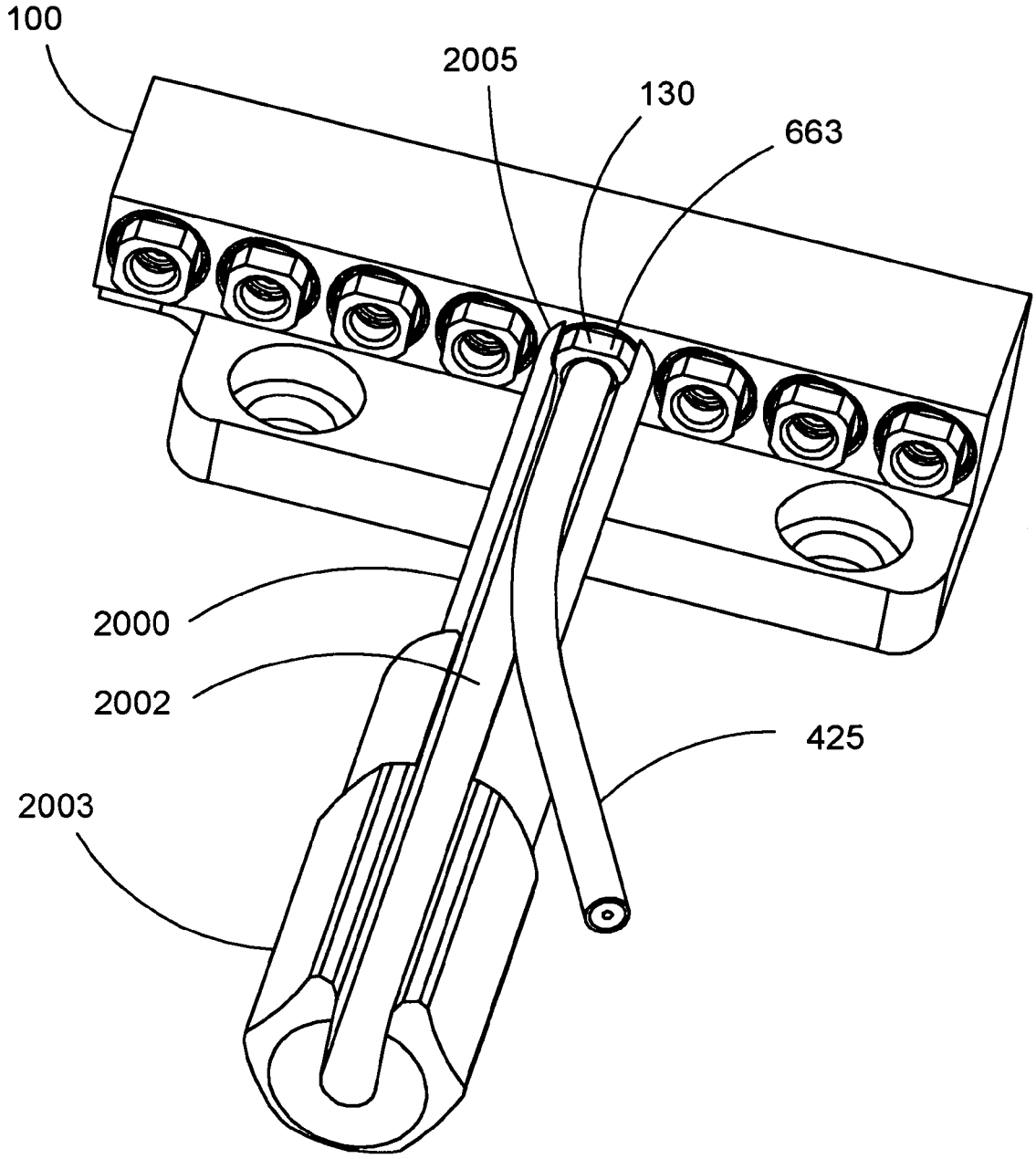
FIG. 22 is a perspective view showing the use of the torque tool of FIG. 20 on a clamp nut of the eight-position, right-angle, coaxial cable-to-male, push-on connector of FIG. 1.

FIG. 22 is a perspective view showing the use of the torque tool 2000 on a clamp nut 130 of the connector 100, and showing coaxial cable 425 advantageously passing through the slot 2002 in the torque tool. As a result of the design of the head 680 of the clamp nut 130 and the design of the torque tool 2000, the torque tool engages the clamp nut while avoiding adjacent clamp nuts.

A connector in accordance with the invention simplifies the testing of a coaxial cable assembly, which comprises a plurality of coaxial cables, because each individual coaxial cable can be rapidly tested. First, at least one male, push-on port 271–278 and 1571–1574 of the coaxial cable-to-male connector 100 and 1400, respectively, is electrically coupled to a testing device. Second, one of the coaxial cables 421–428, having a newly soldered cable adapter 120 on its end, is simply inserted into a corresponding at least one cable port 121–128 and 1421–1424, to quickly test the VSWR of the coaxial cable-cable adapter combination (advantageously, without needing to affix the clamp nut 130 to the coaxial cable-to-male connector).

In preferred embodiments, the connectors 100 and 1400 are preferably sized to accept a coaxial cable 421–428 of the 50-ohm, 0.047-inch, flexible type. Alternatively, the connectors 100 and 1400 are used with other sizes and types of coaxial cables, in which case the connectors are sized accordingly. A connector in accordance with the invention allows multiple coaxial cables 421–428 to be connected to the PWB 1301 or other such devices, while still maintaining the versatility of allowing individual coaxial cables to be easily replaced in the field if they should become worn or damaged. The connectors 100, 1000, 1400 and 1700 preferably work with the standard SMP interface and the standard SMPM interface. In preferred embodiments, the connectors 100, 1000, 1400 and 1700 are used at microwave radio frequencies up to 40-GHz in an SMP version, up to 65-GHz in an SMPM version and up to 100-GHz in a CGP or G3PO version manufactured by Corning Gilbert Inc.

Various modifications and changes may be made to the described embodiment by those skilled in the art without departing from the true spirit and scope of the invention as defined by the appended claims. For example, a connector in accordance with the invention is not limited to having four (4) or eight (8) ports, but may have a larger or a smaller number of ports.

LIST OF REFERENCE NUMERALS

100 Eight-position, right-angle, coaxial cable-to-male, push-on connector
101 Cable side of connector
103 First face of housing
105 Housing
106 Connector assembly
111–118 First set of bores
120 Cable adapter

121–128 Cable ports
130 Clamp nut
140–141 Mounting holes
150 Key pin
160 Nonstandard internal threads
202 Male side of connector
204 Second face of housing
261–268 Second set of bores
271–278 Male push-on ports
301 Right-angle junction
302 Center contact
308–309 Dielectrics
314 Shroud
316 Bushing
318 Male pin
320 Female socket contact
330 Full detent
421–428 Coaxial cable
501 Jacket
502 Outer conductor
503 Insulation
504 Center conductor
511–512 Solder holes
660 Nonstandard external threads
661 Passageway
662 Centerline of clamp nut
663 Head of clamp nut
671–674 Flat sides of head
681–684 Rounded corners of head
690 Rounded inside circular edge
771 Opening
772 Centerline of cable adapter
801 Female-to-female bullet
1000 Eight-position, right-angle, push-on, male-to-PWB connector
1001 Male side of connector
1003 First face of housing
1005 Housing
1011–1018 First set of bores
1021–1028 Male, push-on ports
1040–1041 Mounting holes
1102 PWB side of connector
1104 Second face of housing
1161–1168 Second set of bores
1171–1178 PWB ports
1181–1188 Straight PWB pin
1201 Right-angle junction
1202 Center contact
1208–1209 Dielectrics
1214 Shroud
1216 Bushing
1218 Male pin
1230 Smooth bore
1300 Coaxial cable-to-PWB connector system
1301 Printed Wiring Board (PWB)
1400 Four-position, straight, coaxial cable-to-male, push-on connector
1401 Cable side of connector
1403 First face of housing
1405 Housing
1406 Connector assembly
1411–1414 Set of bores
1421–1424 Cable ports
1440–1441 Mounting holes
1502 Male side of connector
1504 Second face of housing
1571–1574 Male push-on ports
1602 Center contact
1608–1609 Dielectrics
1614 Shroud
1616 Bushing
1618 Male pin
1620 Female socket contact
1630 Full detent
1700 Four-position, straight, push-on, male-to-PWB connector
1701 Male side of connector
1703 First face of housing
1705 Housing
1711–1714 Set of bores
1721–1724 Male push-on ports
1740 Mounting holm
1802 PWB side of connector
1804 Second face of housing
1871–1874 PWB ports
1881–1884 Straight PWB pin
1902 Center contact
1909 Dielectric
1914 Shroud
1918 Male pin
1930 Smooth bore
1951–1954 Rounded outer corners
2000 Torque tool
2001 Elongated hollow segment
2002 Slot
2003 Handle
2005 Tip
2072–2074 Flat surfaces
2082–2083 Chamfers

What is claimed is:

1. A multi-port, right-angle, coaxial cable-to-male, push-on, connector assembly, for terminating a plurality of coaxial cables, comprising:

a multi-port, right-angle, coaxial cable-to-male, push-on, connector having a cable side and a male side, the plane of the cable side being at a right angle to the plane of the male side;

a first set of bores extending into the multi-port, right-angle, coaxial cable-to-male, push-on, connector, the axis of each bore of the first set of bores being perpendicular to the plane of the cable side;

a second set of bores extending into the multi-port, right-angle, coaxial cable-to-male, push-on, connector, the axis of each bore of the second set of bores being perpendicular to the plane of the male side, such that respective bores of the first set of bores and of the second set of bores join within the multi-port, right-angle, coaxial cable-to-male, push-on, connector;

a cable port on the cable side of the multi-port, right-angle, coaxial cable-to-male, push-on, connector at each bore of the first set of bores, each cable port having internal threads;

a cable adapter attached to an end of each coaxial cable of the plurality of coaxial cables, thereby forming a coaxial cable-cable adapter combination;

a clamp nut having external threads, a portion of the clamp nut extending out of the housing, the clamp nut for removably attaching one coaxial cable-cable adapter combination to one of the cable ports; and a male, push-on port on the male side of the multi-port, right-angle, coaxial cable-to-male, push-on, connector at each bore of the second set of bores, each male, push-on port being electrically coupled within one of the bores to a corresponding cable port by a bent center contact disposed within a corresponding pair of bores of the first and second sets of bores, wherein one end of the bent center contact terminates in a male pin end disposed within the male, push-on port, and wherein the bent center contact terminates in a female socket contact disposed proximate the cable port, wherein each coaxial cable-cable adapter combination is separately field replaceable from the multi-port, right-angle, coaxial cable-to-male, push-on, connector.

2. The multi-port, right-angle, coaxial cable-to-male, push-on, connector of claim 1, in which the male, push-on port has a SMP interface.

3. The multi-port, right-angle, coaxial cable-to-male, push-on, connector of claim 1, in which the male, push-on port has a SMPM interface.

4. The multi-port, right-angle, coaxial cable-to-male, push-on, connector of claim 1, in which the cable port is sized for a 0.047 diameter coaxial cable.

5. The multi-port, right-angle, coaxial cable-to-male, push-on, connector assembly of claim 1, in which the cable adapter is thermally separable from the connector, and in which the cable adapter is attached to the end of the coaxial cable by solder.

6. The multi-port, right-angle, coaxial cable-to-male, push-on, connector assembly of claim 1, in which the coaxial cable-cable adapter combination is removably attached to the cable port by a threaded connection between the clamp nut and the cable port.

7. The multi-port, right-angle, coaxial cable-to-male, push-on, connector assembly of claim 1, in which each cable port has nonstandard internal threads, and in which the clamp nut has matching nonstandard outside threads.

8. The multi-port, right-angle, coaxial cable-to-male, push-on, connector assembly of claim 7, in which the clamp nut has a centerline and in which the clamp nut includes a cylindrical-shaped passageway through the clamp nut along the centerline, the passageway being sized for one coaxial cable to pass therethrough.

9. The multi-port, right-angle, coaxial cable-to-male, push-on, connector assembly of claim 8, in which the cylindrical-shaped passageway of the clamp nut includes an entrance for the coaxial cable on one side of the clamp nut, the entrance having a rounded inside edge to act as a strain relief for the coaxial cable.

10. The multi-port, right-angle, coaxial cable-to-male, push-on, connector assembly of claim 9, in which the clamp nut includes a head having four flat sides and four rounded corners.

11. A multi-port, coaxial cable-to-male, push-on connector assembly, for terminating a plurality of coaxial cables to a plurality of single-position, female, push-on connectors, comprising:

a coaxial cable-to male connector having a cable side and a male side;

a plurality of bores extending through the coaxial cable-to-male connector between the cable side and the male side;

a cable port on the cable side of the coaxial cable-to-male connector at each bore, each cable port having internal threads;

a cable adapter attached to the end of each coaxial cable of the plurality of coaxial cables, thereby forming a coaxial cable-cable adapter combination;

a clamp nut having external threads, a portion of the clamp nut extending out of the housing, the clamp nut for removably attaching one coaxial cable-cable adapter combination to one of the cable ports of the coaxial cable-to-male connector; and a male, push-on port on the male side of the coaxial cable-to-male connector at each bore, each male, push-on port being electrically coupled within the connector to a corresponding cable port by a bent center contact disposed within the housing, wherein one end of the bent center contact terminates in a male pin end disposed within the male, push-on port, and wherein the bent center contact terminates in a female socket contact disposed proximate the cable port.

12. The multi-port, coaxial cable-to-male, push-on, connector assembly of claim 11, in which the cable adapter is thermally separable from the connector, and in which the cable adapter is attached to the end of the coaxial cable by solder.

13. The multi-port, coaxial cable-to-male, push-on, connector assembly of claim 11, in which each cable port has nonstandard internal threads; and in which the clamp nut has matching nonstandard outside threads.

14. The multi-port, coaxial cable-to-male, push-on, connector assembly of claim 13, in which the coaxial cable-cable adapter combination is removably attached to the cable port by a threaded connection between the clamp nut and the cable port.

15. A multi-port, right-angle, coaxial cable-to-male, push-on, connector, comprising:

a housing having a first face and a second face, the plane of the second face being at a right angle to the plane of the first face;

a first set of bores extending into the housing from the first face, the axis of each bore of the first set of bores being perpendicular to the plane of the first face;

a second set of bores extending into the housing from the second face, the axis of each bore of the second set of bores being perpendicular to the plane of the second face, such that respective bores of the first set of bores and of the second set of bores join at a right angle within the housing;

a cable port on the first face of the housing at each bore of the first set of bores, each cable port having internal threads;

a male, push-on port on the second face of the housing at each bore of the second set of bores, wherein each cable port is electrically coupled within the housing to a corresponding male, push-on port by a bent center contact disposed within a corresponding pair of bores of the first and second sets of bores, wherein one end of the bent center contact terminates in a male pin end disposed within the male, push-on port, and wherein the bent center contact terminates in a female socket contact disposed proximate the cable port;

a cable side comprising the first face;

a male side comprising the second face, wherein the first set of bores extends through the coaxial cable-to-male connector between the cable side and the male side;

a cable adapter for attachment to the end of each coaxial cable of the plurality of coaxial cables, the cable adapter sized for insertion into the cable port;

a clamp nut having external threads, the clamp nut for removably attaching one coaxial cable and cable adapter combination to one of the cable ports of the coaxial cable-to-male connector;

a male-to-PWB connector having a male side and a PWB side;

at least one other set of bores extending through the male-to-PWB connector between the male side and the PWB side;

a male, push-on port on the male side of the male-to-PWB connector at each bore of the at least one other set of bores;

a PWB port on the PWB side of the male-to-PWB connector at each bore of the at least one other set of bores, each PWB port including a straight PWB pin protruding from the male-to-PWB connector for attachment to a PWB, each PWB port being electrically coupled to a corresponding male, push-on port of the male-to-PWB connector; and a plurality of female-to-female connectors for connecting each male port of the coaxial cable to-male connector with each male port of the male-to-PWB connector, wherein the coaxial cable-to-PWB connector system allows a user to make and break a plurality of coaxial cable-to-PWB connections with a single action.

16. The multi-port, coaxial cable-to-PWB connector system of claim 15 in which the plurality of female-to-female connectors remains attached to the coaxial cable-to-male connector when the plurality of coaxial cable-to-PWB connections is broken.

17. The multi-port, coaxial cable-to-PWB connector system of claim 15 in which the plurality of female-to-female connectors detach from the male-to PWB connector when the plurality of coaxial cable-to-PWB connections is broken.

18. A multi-port, right-angle, coaxial cable-to-male, push-on, connector assembly, for terminating a plurality of coaxial cables, comprising:

a multi-port, right-angle, coaxial cable-to-male, push-on, connector having a cable side and a male side, the plane of the cable side being at a right angle to the plane of the male side;

a first set of bores extending into the multi-port, right-angle, coaxial cable-to-male, push-on, connector, the axis of each bore of the first set of bores being perpendicular to the plane of the cable side;

a second set of bores extending into the multi-port, right-angle, coaxial cable-to-male, push-on, connector, the axis of each bore of the second set of bores being perpendicular to the plane of the male side, such that respective bores of the first set of bores and of the second set of bores join within the multi-port, right-angle, coaxial cable-to-male, push-on, connector;

a cable port on the cable side of the multi-port, right-angle, coaxial cable-to-male, push-on, connector at each bore of the first set of bores, each cable port having internal threads;

a cable adapter attached to an end of each coaxial cable of the plurality of coaxial cables, thereby forming a coaxial cable-cable adapter combination;

a clamp nut having external threads, the clamp nut for removably attaching one coaxial cable-cable adapter combination to one of the cable ports; and a male, push-on port on the male side of the multi-port, right-angle, coaxial cable-to-male, push-on, connector at each bore of the second set of bores, each male, push-on port being electrically coupled within one of the bores to a corresponding cable port, wherein each coaxial cable-cable adapter combination is separately field replaceable from the multi-port, right-angle, coaxial cable-to-male, push-on, connector;

wherein each cable port has nonstandard internal threads, and wherein the clamp nut has matching nonstandard outside threads.

19. The multi-port, right-angle, coaxial cable-to-male, push-on, connector assembly of claim 18, in which the clamp nut has a centerline and in which the clamp nut includes a cylindrical-shaped passageway through the clamp nut along the centerline, the passageway being sized for one coaxial cable to pass therethrough.

20. The multi-port, right-angle, coaxial cable-to-male, push-on, connector assembly of claim 18, in which the cylindrical-shaped passageway of the clamp nut includes an entrance for the coaxial cable on one side of the clamp nut, the entrance having a rounded inside edge to act as a strain relief for the coaxial cable.

21. The multi-port, right-angle, coaxial cable-to-male, push-on, connector assembly of claim 20, in which the clamp nut includes a head having four flat sides and four rounded corners.

22. A multi-port, right-angle, coaxial cable-to-male, push-on, connector assembly, for terminating a plurality of coaxial cables, comprising:

a multi-port, right-angle, coaxial cable-to-male, push-on, connector having a cable side and a male side, the plane of the cable side being at a right angle to the plane of the male side;

a first set of bores extending into the multi-port, right-angle, coaxial cable-to-male, push-on, connector, the axis of each bore of the first set of bores being perpendicular to the plane of the cable side;

a second set of bores extending into the multi-port, right-angle, coaxial cable-to-male, push-on, connector, the axis of each bore of the second set of bores being perpendicular to the plane of the male side, such that respective bores of the first set of bores and of the second set of bores join within the multi-port, right-angle, coaxial cable-to-male, push-on, connector;

a cable port on the cable side of the multi-port, right-angle, coaxial cable-to-male, push-on, connector at each bore of the first set of bores, each cable port having internal threads;

a cable adapter attached to an end of each coaxial cable of the plurality of coaxial cables, thereby forming a coaxial cable-cable adapter combination;

a clamp nut having external threads, the clamp nut for removably attaching one coaxial cable-cable adapter combination to one of the cable ports; and a male, push-on port on the male side of the multi-port, right-angle, coaxial cable-to-male, push-on, connector at each bore of the second set of bores, each male, push-on port being electrically coupled within one of the bores to a corresponding cable port, wherein each coaxial cable-cable adapter combination is separately field replaceable from the multi-port, right-angle, coaxial cable-to-male, push-on, connector;

wherein the cable adapter is thermally separable from the connector, and wherein the cable adapter is attached to the end of the coaxial cable by solder.

23. A multi-port, coaxial cable-to-male, push-on connector assembly, for terminating a plurality of coaxial cables to a plurality of single-position, female, push-on connectors, comprising:

a coaxial cable-to male connector having a cable side and a male side;

a plurality of bores extending through the coaxial cable-to-male connector between the cable side and the male side;

a cable port on the cable side of the coaxial cable-to-male connector at each bore, each cable port having internal threads;

a cable adapter attached to the end of each coaxial cable of the plurality of coaxial cables, thereby forming a coaxial cable-cable adapter combination;

a clamp nut having external threads, the clamp nut for removably attaching one coaxial cable-cable adapter combination to one of the cable ports of the coaxial cable-to-male connector; and a male, push-on port on the male side of the coaxial cable-to-male connector at each bore, each male, push-on port being electrically coupled within the connector to a corresponding cable port;

wherein each cable port has nonstandard internal threads, and wherein the clamp nut has matching nonstandard outside threads.

24. A multi-port, coaxial cable-to-male, push-on connector assembly, for terminating a plurality of coaxial cables to a plurality of single-position, female, push-on connectors, comprising:

a coaxial cable-to male connector having a cable side and a male side;

a plurality of bores extending through the coaxial cable-to-male connector between the cable side and the male side;

a cable port on the cable side of the coaxial cable-to-male connector at each bore, each cable port having internal threads;

a cable adapter attached to the end of each coaxial cable of the plurality of coaxial cables, thereby forming a coaxial cable-cable adapter combination;

a clamp nut having external threads, the clamp nut for removably attaching one coaxial cable-cable adapter combination to one of the cable ports of the coaxial cable-to-male connector; and a male, push-on port on the male side of the coaxial cable-to-male connector at each bore, each male, push-on port being electrically coupled within the connector to a corresponding cable port;

wherein the cable adapter is thermally separable from the connector, and wherein the cable adapter is attached to the end of the coaxial cable by solder.

25. A multi-port, right-angle, coaxial cable-to-male, push-on, connector, comprising:

a housing having a first face and a second face, the plane of the second face being at a right angle to the plane of the first face;

a first set of bores extending into the housing from the first face, the axis of each bore of the first set of bores being perpendicular to the plane of the first face;

a second set of bores extending into the housing from the second face, the axis of each bore of the second set of bores being perpendicular to the plane of the second face, such that respective bores of the first set of bores and of the second set of bores join at a right angle within the housing;

a cable port on the first face of the housing at each bore of the first set of bores, each cable port having internal threads;

a male, push-on port on the second face of the housing at each bore of the second set of bores, wherein each cable port is electrically coupled within the housing to a corresponding male, push-on port;

a cable side comprising the first face;

a male side comprising the second face, wherein the first set of bores extends through the coaxial cable-to-male connector between the cable side and the male side;

a cable adapter for attachment to the end of each coaxial cable of the plurality of coaxial cables, the cable adapter sized for insertion into the cable port;

a clamp nut having external threads, the clamp nut for removably attaching one coaxial cable and cable adapter combination to one of the cable ports of the coaxial cable-to-male connector;

a male-to-PWB connector having a male side and a PWB side;

at least one other set of bores extending through the male-to-PWB connector between the male side and the PWB side;

a male, push-on port on the male side of the male-to-PWB connector at each bore of the at least one other set of bores;

a PWB port on the PWB side of the male-to-PWB connector at each bore of the at least one other set of bores, each PWB port including a straight PWB pin protruding from the male-to-PWB connector for attachment to a PWB, each PWB port being electrically coupled to a corresponding male, push-on port of the male-to-PWB connector; and a plurality of female-to-female connectors for connecting each male port of the coaxial cable to-male connector with each male port of the male-to-PWB connector, wherein the coaxial cable-to-PWB connector system allows a user to make and break a plurality of coaxial cable-to-PWB connections with a single action.

26. The multi-port, coaxial cable-to-PWB connector system of claim 25 in which the plurality of female-to-female connectors remains attached to the coaxial cable-to-male connector when the plurality of coaxial cable-to-PWB connections is broken.

27. The multi-port, coaxial cable-to-PWB connector system of claim 25 in which the plurality of female-to-female connectors detach from the male-to PWB connector when the plurality of coaxial cable-to-PWB connections is broken.

28. A multi-port, right-angle, coaxial cable-to-male, push-on, connector assembly, for terminating a plurality of coaxial cables, comprising:

a multi-port, right-angle, coaxial cable-to-male, push-on, connector having a cable side and a male side, the plane of the cable side being at a right angle to the plane of the male side;

a first set of bores extending into the multi-port, right-angle, coaxial cable-to-male, push-on, connector, the axis of each bore of the first set of bores being perpendicular to the plane of the cable side;

a second set of bores extending into the multi-port, right-angle, coaxial cable-to-male, push-on, connector, the axis of each bore of the second set of bores being perpendicular to the plane of the male side, such that respective bores of the first set of bores and of the second set of bores join within the multi-port, right-angle, coaxial cable-to-male, push-on, connector;

a cable port on the cable side of the multi-port, right-angle, coaxial cable-to-male, push-on, connector at each bore of the first set of bores, each cable port having internal threads;

a cable adapter attached to an end of each coaxial cable of the plurality of coaxial cables, thereby forming a coaxial cable-cable adapter combination;

a clamp nut having external threads, a portion of the clamp nut extending out of the housing, the clamp nut for removably attaching one coaxial cable-cable adapter combination to one of the cable ports; and a male, push-on port on the male side of the multi-port, right-angle, coaxial cable-to-male, push-on, connector at each bore of the second set of bores, each male, push-on port being electrically coupled within one of the bores to a corresponding cable port, wherein each coaxial cable-cable adapter combination is separately field replaceable from the multi-port, right-angle, coaxial cable-to-male, push-on, connector.

29. The multi-port, right-angle, coaxial cable-to-male, push-on, connector assembly of claim 28, in which each cable port has nonstandard internal threads, and in which the clamp nut has matching nonstandard outside threads.

30. The multi-port, right-angle, coaxial cable-to-male, push-on, connector assembly of claim 29, in which the clamp nut has a centerline and in which the clamp nut includes a cylindrical-shaped passageway through the clamp nut along the centerline, the passageway being sized for one coaxial cable to pass therethrough.

31. The multi-port, right-angle, coaxial cable-to-male, push-on, connector assembly of claim 30, in which the cylindrical-shaped passageway of the clamp nut includes an entrance for the coaxial cable on one side of the clamp nut, the entrance having a rounded inside edge to act as a strain relief for the coaxial cable.

32. The multi-port, right-angle, coaxial cable-to-male, push-on, connector assembly of claim 31, in which the clamp nut includes a head having four flat sides and four rounded corners.

33. The multi-port, right-angle, coaxial cable-to-male, push-on, connector assembly of claim 28, in which the cable adapter is thermally separable from the connector, and in which the cable adapter is attached to the end of the coaxial cable by solder.

34. The multi-port, right-angle, coaxial cable-to-male, push-on, connector assembly of claim 28, in which the coaxial cable-cable adapter combination is removably attached to the cable port by a threaded connection between the clamp nut and the cable port.

35. A multi-port, coaxial cable-to-male, push-on connector assembly, for terminating a plurality of coaxial cables to a plurality of single-position, female, push-on connectors, comprising:

a coaxial cable-to male connector having a cable side and a male side;

a plurality of bores extending through the coaxial cable-to-male connector between the cable side and the male side;

a cable port on the cable side of the coaxial cable-to-male connector at each bore, each cable port having internal threads;

a cable adapter attached to the end of each coaxial cable of the plurality of coaxial cables, thereby forming a coaxial cable-cable adapter combination;

a clamp nut having external threads, a portion of the clamp nut extending out of the housing, the clamp nut for removably attaching one coaxial cable-cable adapter combination to one of the cable ports of the coaxial cable-to-male connector; and a male, push-on port on the male side of the coaxial cable-to-male connector at each bore, each male, push-on port being electrically coupled within the connector to a corresponding cable port.

36. The multi-port, coaxial cable-to-male, push-on, connector assembly of claim 35, in which the cable adapter is thermally separable from the connector, and in which the cable adapter is attached to the end of the coaxial cable by solder.

37. The multi-port, coaxial cable-to-male, push-on, connector assembly of claim 35, in which each cable port has nonstandard internal threads; and in which the clamp nut has matching nonstandard outside threads.

38. The multi-port, coaxial cable-to-male, push-on, connector assembly of claim 37, in which the coaxial cable-cable adapter combination is removably attached to the cable port by a threaded connection between the clamp nut and the cable port.

* * * * *